US006483050B1

(12) United States Patent
Narusawa et al.

(10) Patent No.: US 6,483,050 B1
(45) Date of Patent: Nov. 19, 2002

(54) KEY SWITCH WITH EASILY ATTACHABLE KEY TOP

(75) Inventors: Tsuyoshi Narusawa, Fukushima-ken (JP); Masaaki Kageyama, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 19 days.

(21) Appl. No.: 09/696,712

(22) Filed: Oct. 24, 2000

(30) Foreign Application Priority Data

| | | |
|---|---|---|
| Nov. 11, 1999 | (JP) | 11-321232 |
| Aug. 3, 2000 | (JP) | 2000-063892 |
| Aug. 3, 2000 | (JP) | 2000-063895 |
| Aug. 3, 2000 | (JP) | 2000-063903 |

(51) Int. Cl.[7] ..... H01H 13/70
(52) U.S. Cl. ..... 200/5 A; 200/344; 200/345
(58) Field of Search ..... 200/344, 345, 200/5 A; 29/622

(56) References Cited

U.S. PATENT DOCUMENTS

| | | | | |
|---|---|---|---|---|
| 5,463,195 A | | 10/1995 | Watanabe et al. | 200/344 X |
| 5,847,337 A | | 12/1998 | Chen | 200/344 X |
| 6,107,584 A | * | 8/2000 | Yoneyama | 200/344 |
| 6,236,003 B1 | * | 5/2001 | Suganami | 200/344 |

* cited by examiner

*Primary Examiner*—J. R. Scott
(74) *Attorney, Agent, or Firm*—Beyer Weaver & Thomas LLP

(57) ABSTRACT

A key switch includes an actuator for rotatably engaging the upper end of one of lever members, which constitute a cross-linked member, therewith and slidably engaging the upper end of the other lever member therewith. After the cross-linked member engaged with the actuator at its upper end is mounted on a membrane switch, the bottom of a key top is retained on the actuator by a simple means a as press fitting. This simplifies a molding die for the key top and facilitates an operation of attaching the key top.

26 Claims, 25 Drawing Sheets

KEY SWITCH WITH EASILY ATTACHABLE KEY TOP

CROSS REFERENCE TO RELATED APPLICATION

This application is related to U.S. patent application Ser. No. 09/696,403 filed on the same date herewith and entitled "KEY SWITCH DISPOSED ON KEYBOARD INPUT DEVICE AND METHOD OF PRODUCING THE SAME," the content of which is hereby incorporated by reference.

BACKGROUND OF THE INVENTION

1. Field of the Invention

The present invention relates to key switches used for use in a keyboard input device, and more particularly, to key switches each having a cross-linked member.

2. Description of the Related Art

Various types of key switches suitable for lower-profile keyboard input devices have been recently proposed. In such key switches, a key top is supported by the upper ends of a pair of cross-linked lever members. The angle at which the lever members cross changes in response to the upward and downward movement of the key top.

For example, a key switch is disclosed in which a cross-linked member for guiding the upward and downward movement of a key top is formed by cross-linking one lever member, which is rotatably engaged at its upper end with the bottom of the key top, and the other lever member which is slidably engaged at its upper end with the bottom of the key top.

In this type of key switch, when an operator depresses the key top, the lever members are tilted and the cross-linked member is folded down. When the key top is moved down by a predetermined amount, an elastic member, such as a rubber click member, is pressed and buckled by the key top. Consequently, a switch device, such as a membrane switch, is depressed by the elastic member, thereby bringing about a switch-on state.

When the depressing force applied to the key top is terminated in this switch-on state, the buckled elastic member returns to its initial shape due to its inherent elastic characteristics. Consequently, the switch device returns to an off state and the key top is pushed up to its initial position while raising the tilted lever members.

According to such a configuration in which the key top is supported by the cross-linked member so that it can move up and down, it is possible to enhance operability and to substantially reduce the height of the switch, compared with a conventional key switch in which a key stem is slid along a guide wall.

In this key switch, however, the structure for supporting the lower end of the cross-linked member (a pair of lever members) is complicated. This requires substantial amounts of time to mount the cross-linked member and increases the costs.

After the cross-linked member is mounted on the switch device, such as a membrane switch, the key top is attached to the upper end of the cross-linked member, thereby completing the assembly operation of the key switch. Since the key top is large enough to cover the cross-linked member, however, it is difficult to visually check the assembly operation of properly engaging the upper ends of the lever members constituting the cross-linked member with the bottom of the key top. Therefore, and the checking operation must be performed using the experience and intuition of the operator.

That is, in order to quickly and precisely perform operations of rotatably engaging the upper end of one lever member with the bottom of the key top and slidably engaging the upper end of the other lever member with the bottom of the key top in a state in which the engaging portions are not visible, the operator must be highly skilled. Therefore, if the operator is unskilled, operating efficiency and reliability are seriously lowered.

Furthermore, the bottom of the key top is provided with a recess which points downward and is surrounded by a wall. In order to form therein a shaft groove or a slide groove to be engaged with the upper end of the cross-linked member and a pressing protuberance to be contacted with the elastic member, such as a rubber click member, a significantly complicated molding die is required and this increases the manufacturing cost of the key top.

SUMMARY OF THE INVENTION

Accordingly, the present invention has been made to solve the above problems in the conventional arts, and it is an object of the present invention to provide an inexpensive key switch which can be easily mounted and which improves productivity.

In order to achieve the above object, according to an aspect of the present invention, there is provided a key switch that includes a pair of lever members with intersections rotatably connected. An actuator rotatably engages the upper end of one of the lever members therewith and slidably engages the upper end of the other lever member therewith. A key top is retained by the actuator and a supported movably up and down by the lever members. An elastic member, such as a rubber click member, urges the key top upward via the actuator and a switch device, such as a membrane switch, performs a switching operation in response to the upward and downward movement of the key top.

When assembling the key switch, the upper end of the cross-linked member constituted by the lever members is engaged with the actuator beforehand. After the cross-linked member is mounted on the switch device, the bottom of the key top is held on the cross-linked member by a simple means, such as press fitting. This makes it possible to mount the key top more easily than in a conventional case in which the bottom of the key top is engaged with the cross-linked member. If the actuator has such a shape that its portion engaged with the cross-linked member is exposed, there is no problem. Therefore, the actuator can be easily engaged with the cross-linked member. Furthermore, since the bottom of the key top need not have an engaging portion to be engaged with the cross-linking member and a projection for pressing the elastic member, a complicated die is not necessary for molding the key top, which substantially reduces the cost of the die.

According to another aspect of the present invention, there is provided a key switch including a switch device, such as, a membrane switch, having a plurality of switch bodies, for example, each composed of an upper electrode and a lower electrode, consecutively arranged at predetermined intervals. A support member, such as a plate, is placed on the switch device so as to have through portions, support portions and switch pressing portions. The through portions, for example, may be through holes or cutouts. The support portions, such as louver portions, are formed at positions corresponding to the switch bodies of the switch device. The switch pressing portions are supported by the support portions of the support member so as to individually press the switch bodies, for example, the switch pressing portions each being composed of a cross-linked member. The key switch also includes an actuator, a rubber click member, and a key top.

In this key switch, the switch device has a plurality of switch bodies arranged consecutively, and the support member has a plurality of support portions and through portions arranged consecutively so as to support the switch pressing portions. The switch bodies are opposed to the through portions. Since the switch pressing portions supported by the support portions automatically correspond to the switch bodies, it is possible to reduce the number of components, to facilitate assembly operation, and to allow automatic assembly.

According to a further aspect of the present invention, there is provided a key switch including a pair of lever members, such as an inner lever member and an outer lever member, with intersections thereof rotatably connected. A key top is supported by the lever members so as to move up and down. An elastic member, such as a rubber click member, urges the key top upward. A switch device, such as a membrane switch, performs switching in response to the upward and downward movement of the key top and a plate, formed by bending (stamping) a metal plate, has a first louver portion that slidably engages the lower end of one of the lever members therewith and has a second louver portion that rotatably engages the lower end of the other lever member therewith.

In this case, the first and second louver portions for engaging the lower ends of the lever members can be simultaneously formed by bending a metal plate, and the shape of the plate is simple. This makes it possible to easily produce the plate, to improve productivity, and to reduce cost.

Preferably, the key switch further includes an actuator for rotatably engaging the upper end of one of the lever members therewith and slidably engaging the upper end of the other lever member therewith, and the key top is retained by the actuator.

In this case, it is only necessary in the assembly process to engage the upper end of the cross-linked member constituted by the lever members with the actuator beforehand and to hold the bottom of the key top on the actuator via a simple means, such as by press fitting, after the cross-linked member is mounted on the switch device. Therefore, the key top can be mounted more easily than in a conventional case in which the bottom of the key top is engaged with the cross-linked member. If the actuator has such a shape that its portion engaged with the cross-linked member is exposed, there is no problem. Therefore, the actuator can be easily engaged with the cross-linked member. Furthermore, since the bottom of the key top need not have an engaging portion to be engaged with the cross-linking member and a projection for pressing the elastic member, a complicated die is not necessary for molding the key top, which substantially reduces the cost of the die.

Preferably, the actuator has a retaining hole or a projection, the bottom of the key top has a projection or a retaining hole, and the projection is fitted in the retaining hole. This makes it possible to easily attach the key top to the actuator.

Preferably, the plate has a through portion, such as a through hole or a cutout, and a pressing protuberance formed in the elastic member that is placed above the through portion. The switch device is placed below the through portion, and the pressing protuberance and the switch device are opposed to each other via the through portion.

The pressing protuberance of the elastic member and the switch device are opposed to each other via the through portion of the plate, and the switch device is pressed and positioned by the plate. This makes it possible to maintain an appropriate opposing relationship between the switch device and the pressing protuberance of the elastic member.

The key switch may further include a base member, such as a holding plate for positioning and holding the plate, while the switch device is held between the base member and the plate. In this case, the opposing relationship between the plate and the switch device is properly maintained, and the switch device is protected by the plate and the base member.

According to a further aspect of the present invention, there is provided a key switch including a pair of lever members with intersections thereof rotatably connected. A key top is supported by the lever members so as to move up and down. A plate is provided for supportingly mounting the lever members thereon. A holding plate is provided for holding and retaining the plate. An elastic member urges the key top upward. A membrane switch performs switching in response to the upward and downward movement of the key top, and a support plate is provided for mounting the membrane switch thereon. According to this aspect of the invention, the plate and the holding plate have a through hole for inserting the elastic member therein, and the membrane switch is held between the holding plate and the support plate. It is possible to check whether the cross-linked member operates properly in such a configuration since the cross-linked member can be formed by mounting a pair of lever members as a unit on the plate. For this reason, defective cross-linked members will not be mounted, and it is possible to avoid wasting existing components and to prevent operability from being lowered during assembly. Moreover, since the plate for supportingly holding the cross-linked member can be placed on the holding plate, it is unnecessary to form louver portions in the support plate so as to engage with the bottom end of the cross-linked member, and to form multiple holes in the membrane switch so as to pass the louver portions therethrough. This ensures a sufficiently wide space in the membrane switch for a layout pattern and easily improves the degree of freedom in design and reliability.

Preferably, the plate has a first louver portion for rotatably engaging the lower end of one of the lever members therewith and a second louver portion for slidably engaging the lower end of the other lever member therewith. This allows the cross-linked member to operate smoothly.

Preferably, a plurality of pairs of lever members are supportingly mounted on the plate. In this case, since a unit having a plurality of cross linked members arranged in parallel can be obtained, it is possible to efficiently assemble key switches in the keyboard input device.

According to a still further aspect of the present invention, there is provided a key switch including a pair of lever members, such as an inner lever member and an outer lever member, with intersections thereof rotatably connected. A key top is supported by the lever members so as to move up and down. An elastic member, such as a rubber click member, urges the key top upward. A switch device, such as a membrane switch, performs switching in response to the upward and downward movement of the key top, and a plate having a first louver portion slidably engages the lower end of one of the lever members therewith, a second louver portion rotatably engages the lower end of the other lever member therewith, and a protuberance. The protuberance is formed adjacent to the leading end of the second louver portion, wherein the lower end of the other lever member is rotatably snapped into the second louver portion from between the leading end of the second louver portion and the protuberance.

In this case, it is possible to provide an inexpensive key switch which permits the lever members to be easily attached to the plate and which provides high productivity.

The key switch may further include an actuator for rotatably engaging the upper end of one of the lever members therewith and slidably engaging the upper end of the other lever member therewith, and the actuator may retain the key top.

In this case, it is only necessary in the assembly process to engage the upper end of the cross-linked member constituted by the lever members with the actuator beforehand and to hold the bottom of the key top on the actuator via a simple means, such as by press fitting, after the cross-linked member is mounted on the switch device. Therefore, the key top can be mounted more easily than in a conventional case in which the bottom of the key top is engaged with the cross-linked member. If the actuator has such a shape that its portion engaged with the cross-linked member is exposed, there is no problem. Therefore, the actuator-can be easily engaged with the cross-linked member. Furthermore, since the bottom of the key top need not have an engaging portion to be engaged with the cross-linking member and a projection for pressing the elastic member, a complicated die is not necessary for molding the key top, which substantially reduces the cost of the die.

Preferably, the actuator has a retaining hole or projection, the bottom of the key top has a projection or a retaining hole, and the projection is fitted in the retaining hole. This allows the key top to be easily attached to the actuator.

Preferably, the plate has a through portion, such as a through hole or a cutout, a pressing protuberance formed in the elastic member is placed above the through portion, the switch device is placed below the through portion, and the pressing protuberance and the switch device are opposed to each other via the through portion. This makes it possible to maintain an appropriate opposing relationship between the switch device and the pressing protuberance of the elastic member.

The key switch may further include a base member, such as a holding plate, for positioning and holding the plate, and the switch device may be held between the base member and the plate. In this case, the opposing relationship between the plate and the switch device is properly maintained, and the switch device is protected by the plate and the base member.

Further objects, features, and advantages of the present invention will be apparent from the following description of the preferred embodiments with reference to the attached drawings.

DESCRIPTION OF THE PREFERRED EMBODIMENTS

Preferred embodiments of the present invention will be described below with reference to the attached drawings.

Figure 1:
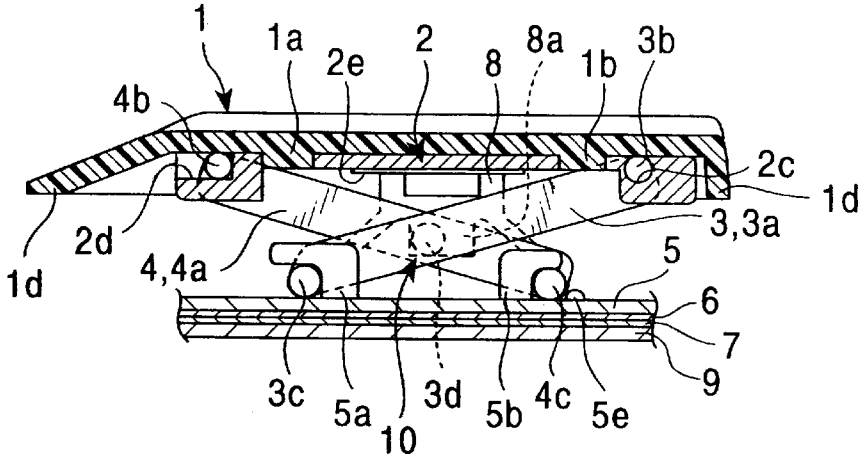
FIG. 1 is a cross-sectional view of a key switch according to a first embodiment of the present invention.
Figure 2:
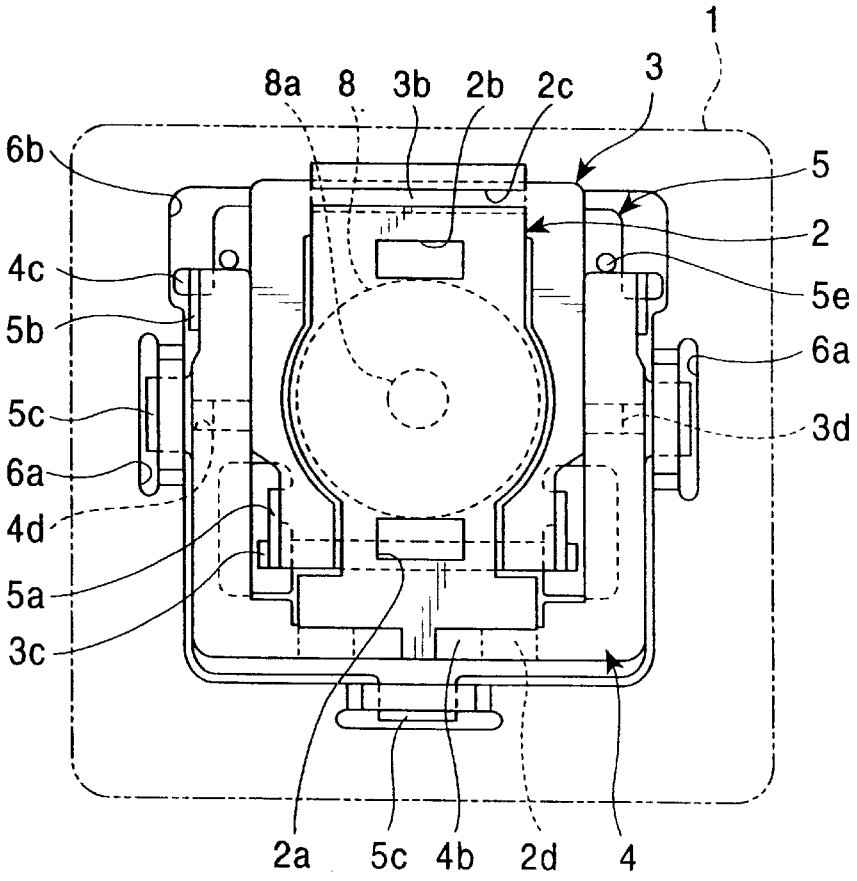
FIG. 2 is a plan view of the key switch.
Figure 3:
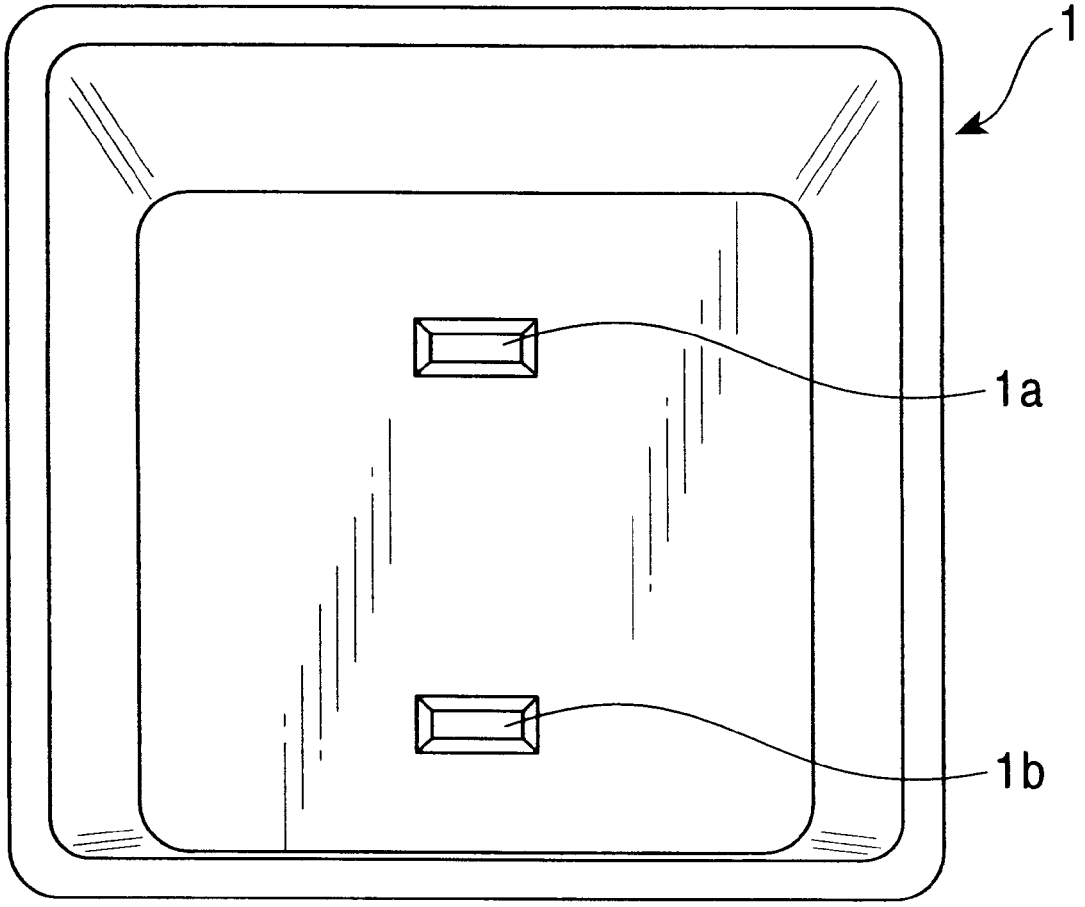
FIG. 3 is a bottom view of a key top.
Figure 4:
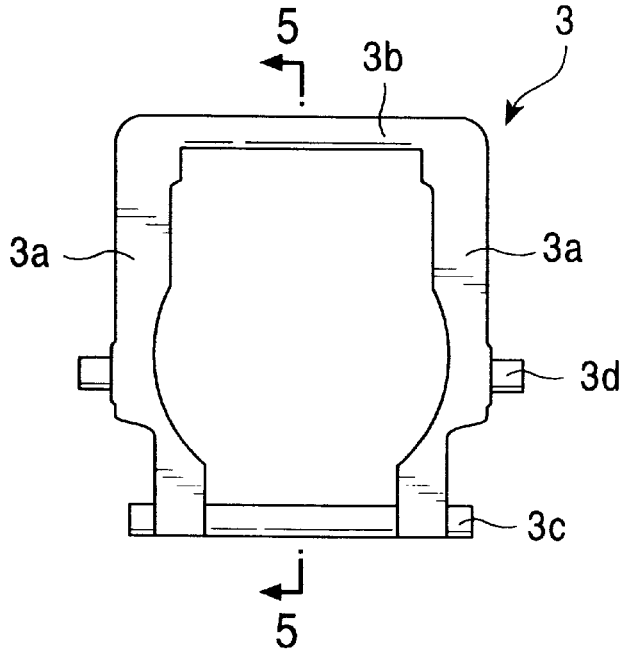
FIG. 4 is a plan view of an inner lever member.
Figure 5:
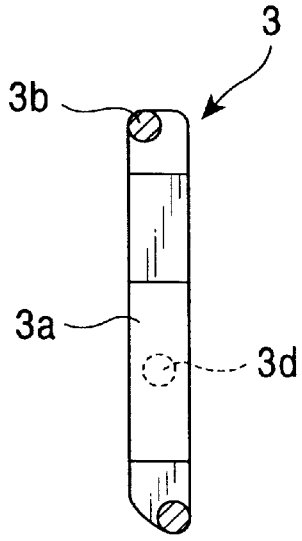
FIG. 5 is a cross-sectional view of the inner lever member, taken along line 5—5 in FIG. 4.
Figure 6:
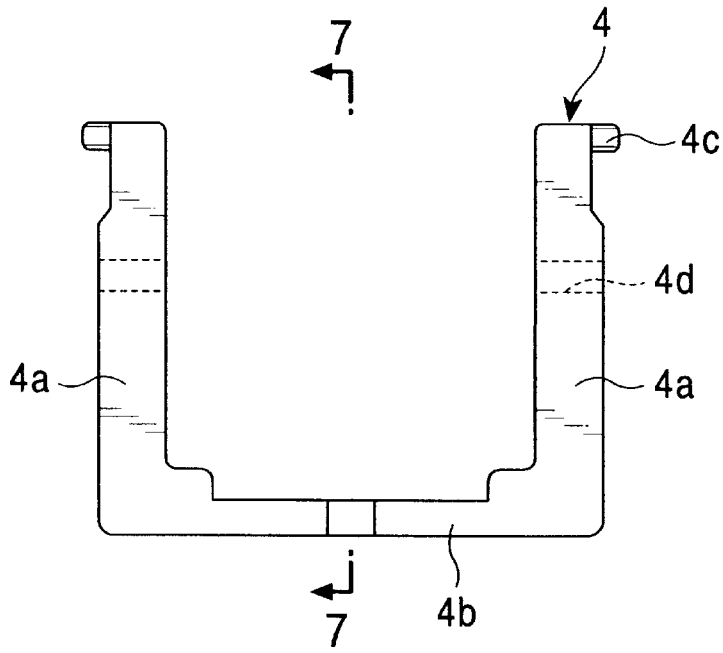
FIG. 6 is a plan view of an outer lever member.
Figure 7:
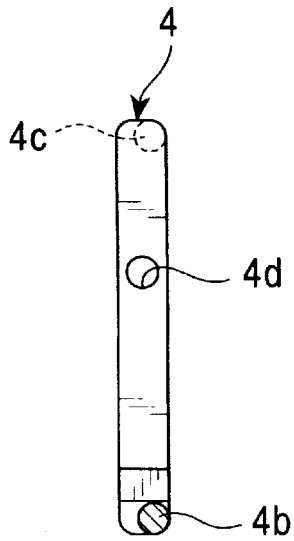
FIG. 7 is a cross-sectional view of the outer lever member, taken along line 7—7 in FIG. 6.
Figure 8:
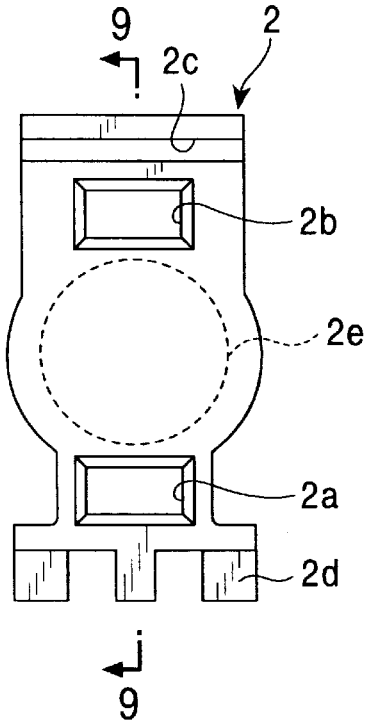
FIG. 8 is a plan view of an actuator.
Figure 9:
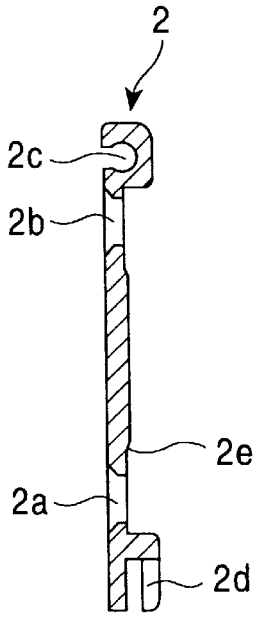
FIG. 9 is a cross-sectional view of the actuator, taken along line 9—9 in FIG. 8.
Figure 10:
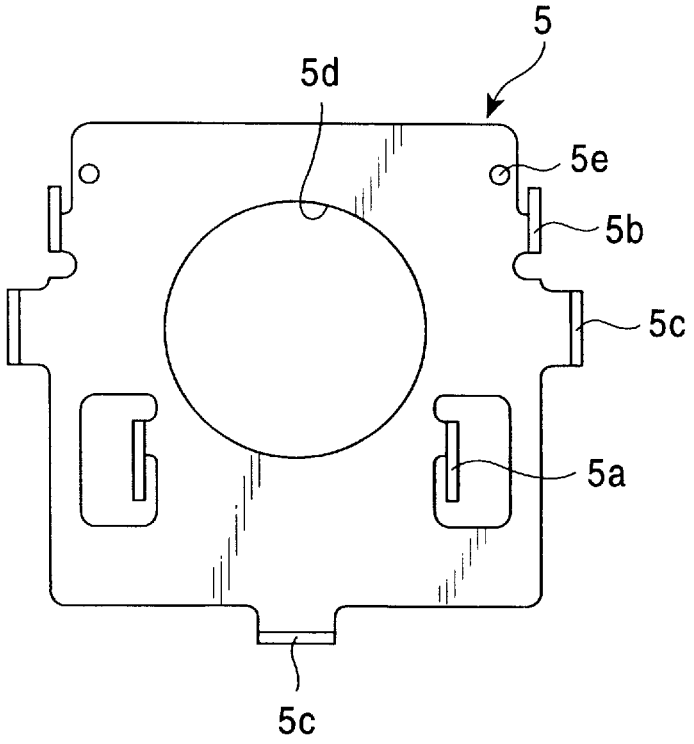
FIG. 10 is a plan view of a plate.
Figure 11:
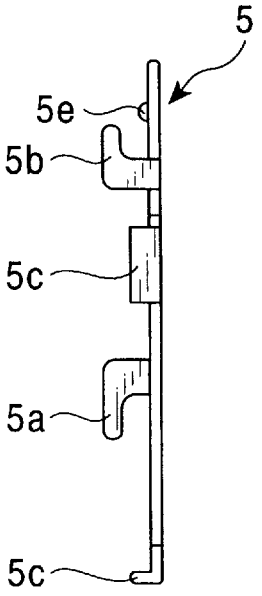
FIG. 11 is a side view of the plate.
Figure 12:
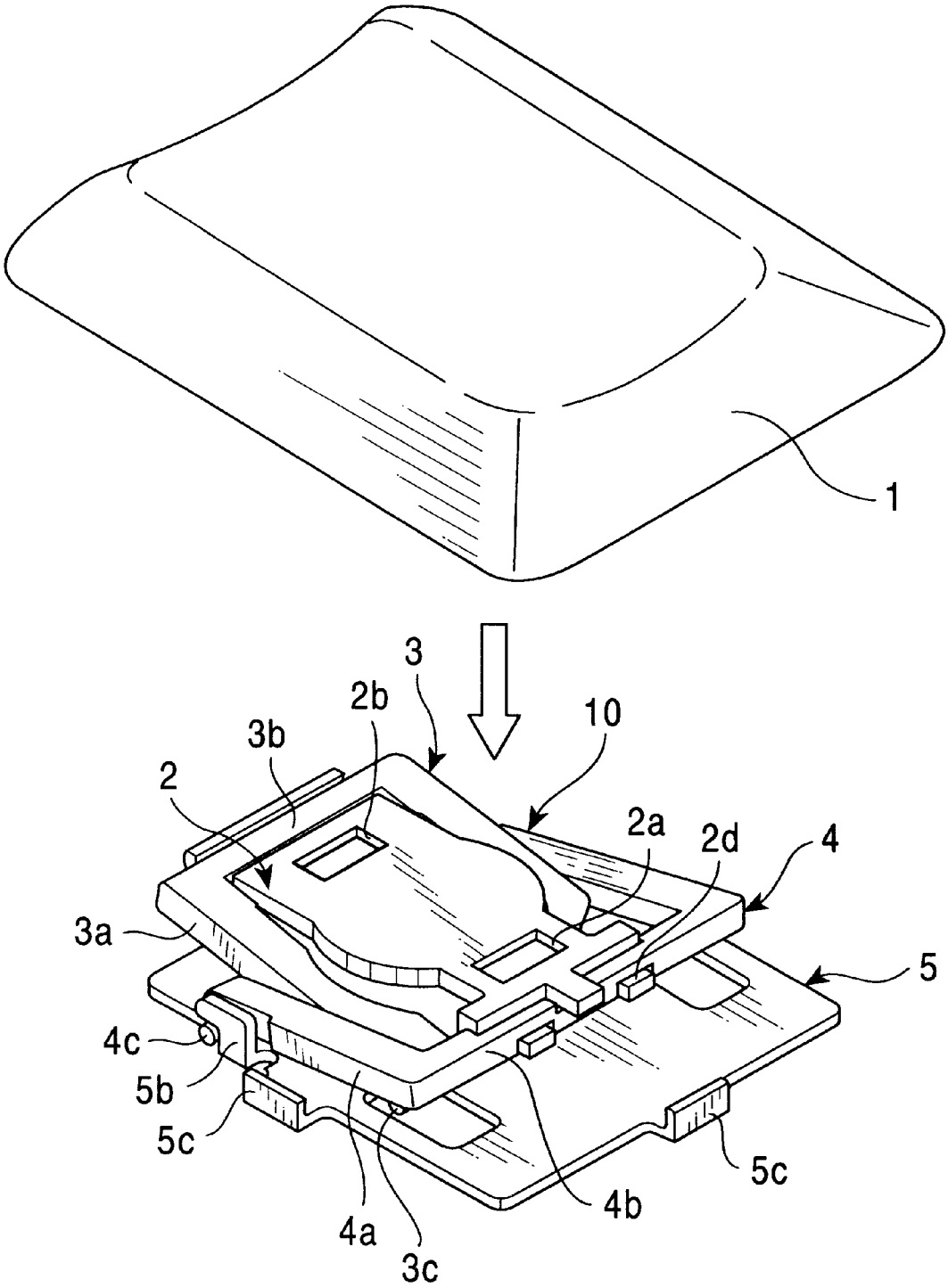
FIG. 12 is a perspective view of a cross-linked member.
Figure 13:
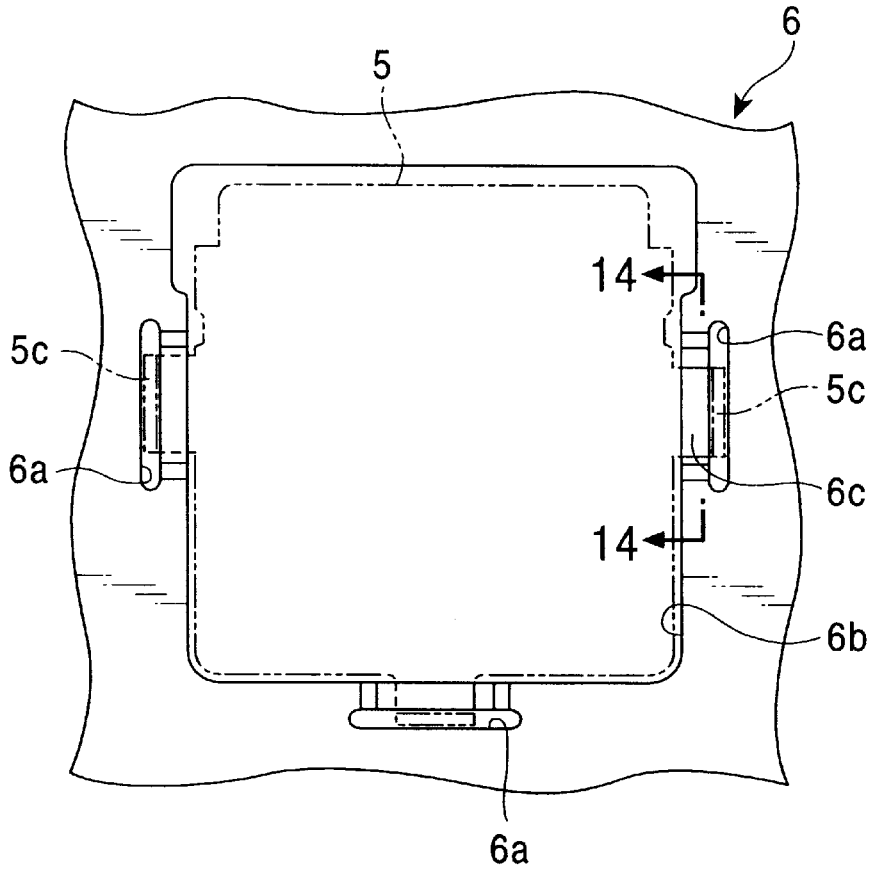
FIG. 13 is a plan view showing the principal part of a holding plate.
Figure 14:
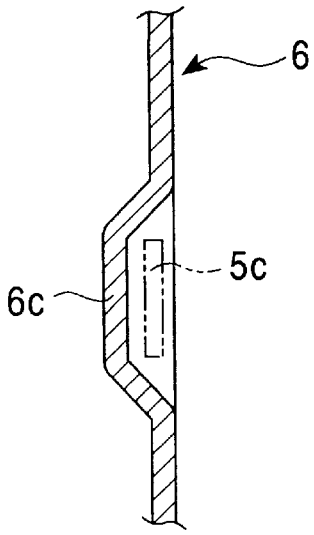
FIG. 14 is a cross-sectional view taken along line 14—14 in FIG. 13.
Figure 15:
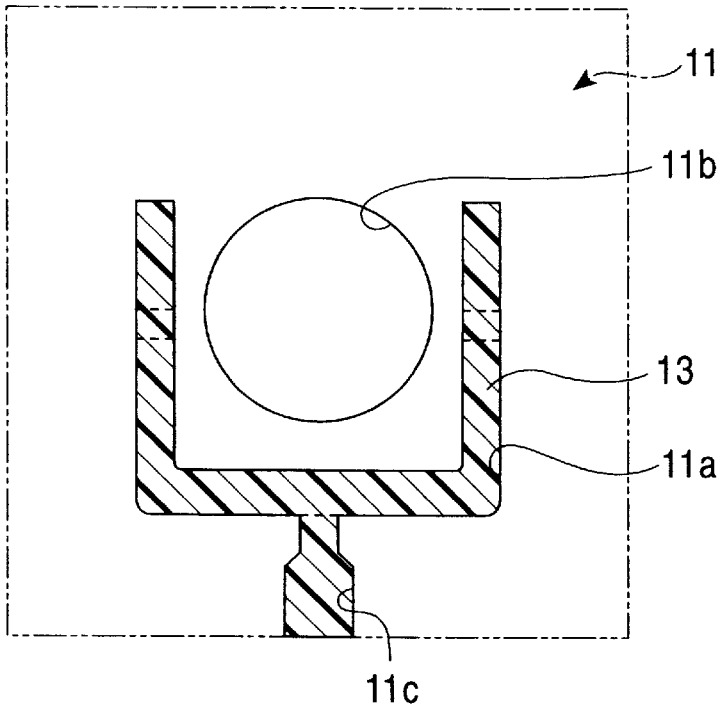
FIG. 15 is an explanatory view of a molding die for the inner lever member.
Figure 16:
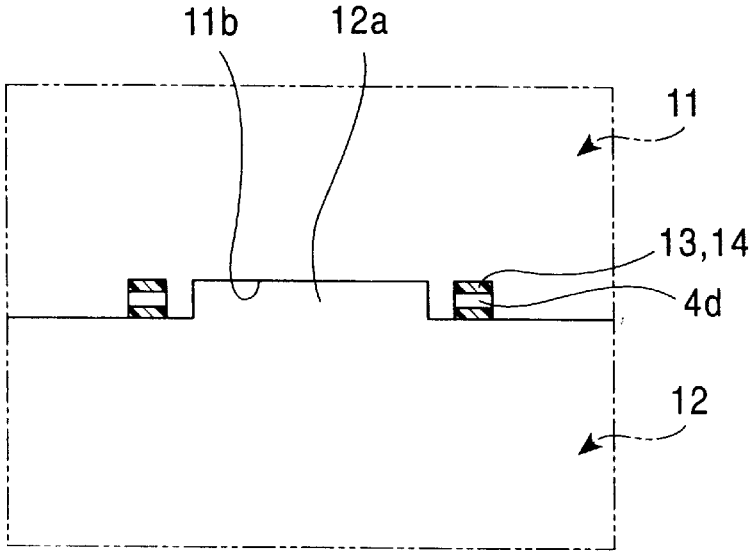
FIG. 16 is a cross-sectional view illustrating a molding process of the inner lever member.
Figure 17:
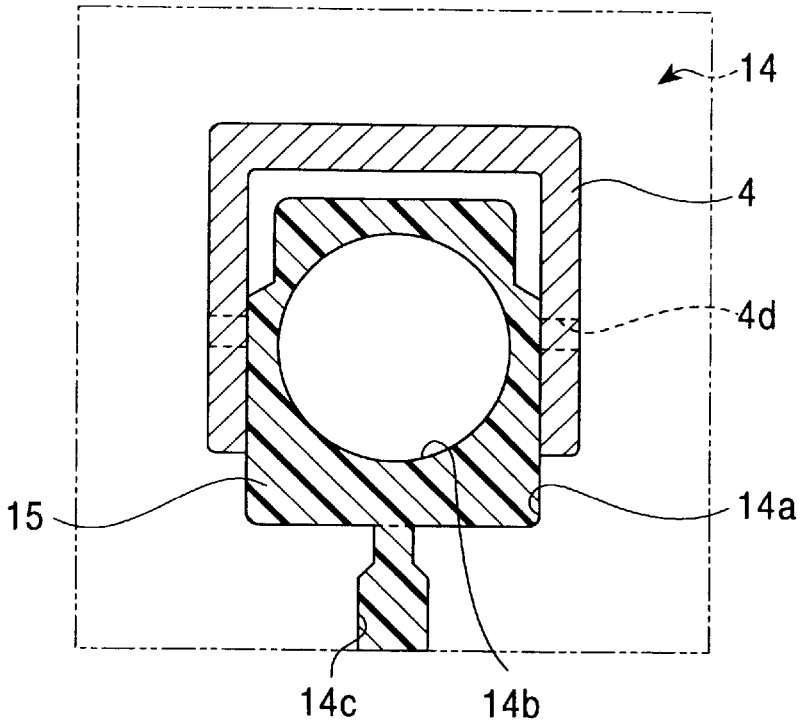
FIG. 17 is an explanatory view of a molding die for the outer lever member.
Figure 18:
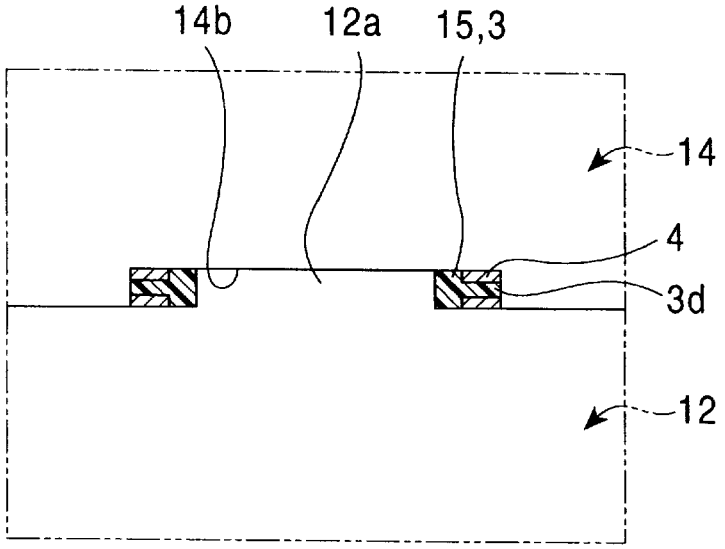
FIG. 18 is a cross-sectional view illustrating a molding process of the outer lever member.

FIG. 1 is a cross-sectional view of a key switch according to a first embodiment of the present invention, FIG. 2 is a plan view of the key switch, FIG. 3 is a rear view of a key top, FIG. 4 is a plan view of an inner lever member, FIG. 5 is a cross-sectional view of the inner lever member, taken along line 5—5 in FIG. 4, FIG. 6 is a plan view of an outer lever member, FIG. 7 is a cross-sectional view of the outer lever member, taken along line 7—7 in FIG. 6, FIG. 8 is a plan view of an actuator, FIG. 9 is a cross-sectional view of the actuator, taken along line 9—9 in FIG. 8, FIG. 10 is a plan view of a plate, FIG. 11 is a side view of the plate, FIG. 12 is a perspective view of a cross-linked member, FIG. 13 is a plan view showing the principal part of a holding plate, FIG. 14 is a cross-sectional view of the part, taken along line 14—14 in FIG. 13, FIG. 15 is an explanatory view of a molding die for the inner lever member, FIG. 16 is a cross-sectional view illustrating a molding process of the inner lever member, FIG. 17 is an explanatory view of a molding die for the outer lever member, and FIG. 18 is a cross-sectional view illustrating a, molding process of the outer lever member.

A key switch of this embodiment generally comprises a key top 1, an actuator 2 for retaining the bottom of the key top 1, an inner lever member 3 and an outer lever member 4 for supporting the key top 1 via the actuator. 2 so that the key top 1 can move up and down, a plate 5 for supporting the pair of lever members 3 and 4 thereon, a holding plate 6 for retaining the plate 5 thereon, a membrane switch 7 for performing switching in response to the upward and downward movement of the key top 1, a rubber click member 8 disposed on the membrane switch 7 so as to urge the key top 1 upward via the actuator 2, and a support plate 9 for holding the membrane switch 7 thereon. The key switch is mounted in a keyboard input device.

The structures of the components of the key switch will now be described in detail. A pair of fitting projections 1*a* and 1*b* are formed on the bottom of the key top. 1, as shown in FIGS. 1 and 3, and a pair of retaining holes 2*a* and 2*b* are formed in the actuator 2, as shown in FIGS. 8 and 9. The fitting projections 1*a* and 1*b* are press-fitted in the retaining holes 2*a* and 2*b*, thereby combining the key top 1 and the actuator 2.

The means for engaging the key top 1 and the actuator 2 is not limited to press fitting. For example, hook portions formed at the leading ends of the fitting projections 1*a* and 1*b* may be caught by the rims of the retaining holes 2*a* and 2*b* so that the key top 1 is less prone to fall off.

The actuator 2 has a shaft groove 2*c* formed at one end in the longitudinal direction so as to rotatably engage the upper end of the inner lever member 3 therewith, and has juts 2*d* formed at the other end in the longitudinal direction so as to slidably engage the upper end of the outer lever member 4 therewith. The actuator 2 also has, at its bottom center, a pressing portion 2*e* for contacting the upper end face of the rubber click member 8.

As shown in FIGS. 4 and 5, the inner lever member 3 is shaped like a frame having a rotating shaft 3*b* at the upper ends of a pair of tilting legs 3*a*, and slide pins 3*c* projecting at the lower ends thereof. A connecting shaft 3*d* is formed at about the center of an outer side face of each tilting leg 3*a* so as to project sideward. As shown in FIG. 1, the rotating shaft 3*b* of the inner lever member 3 are rotatably engaged with the shaft groove 2*c* of the actuator 2, and the slide pins 3*c* are slidably engaged with first louver portions 5*a* of the plate 5, which will be described later.

As shown in FIGS. 6 and 7, the outer lever member 4 is angular-U-shaped and has slide shafts 4*b* at the upper ends of a pair of tilting legs 4a and rotating shafts 4*c* projecting at the lower ends thereof. Shaft insertion holes 4*d* are formed at about the centers of the tilting legs 4*a* so as to extend from the inside to the outside. As shown in FIG. 1, the slide shafts 4*b* of the outer lever member 4 are slidably engaged with the juts 2*d* of the actuator 2, and the rotating shafts 4*c* are rotatably engaged with second louver portions 5*b* of the plate 5, which will be described later.

The inner and outer lever members 3 and 4 are turnably connected at points of intersection thereof so as to constitute a cross-linked member 10. That is, the connecting shafts 3*d* of the inner lever member 3 are rotatably inserted in the shaft insertion holes 4*d* of the outer lever member 4. The height of the cross-linked member 10 changes in accordance with the tilting angle of the tilting legs 3*a* and 4*a* of the lever members 3 and 4.

In this embodiment, the inner and outer lever members 3 and 4 are formed by two-color molding and are assembled as the cross-linked member 10 in a molding process. More specifically, in a state in which a first fixed die 11 having an angular U-shaped cavity 11*a*, a recess 11*b*, a gate 11*c*, and the like and a movable die 12 having a projection 12*a* to be fitted in the recess 11*b* and the like are clamped, a first resin material 13 having a relatively low shrinkage factor (e.g., ABS resin having a shrinkage factor of $^{4}/_{1000}$) is injected into the cavity 11*a* through the gate 11*c* and is solidified by cooling, as shown in FIGS. 15 and 16, thereby molding the outer lever member 4.

In this case, slide cores (not shown) are inserted beforehand in the cavity 11*a* so that the shaft insertion holes 4*d* are formed at about the centers of the tilting legs 4*a* when the first resin material 13 is solidified.

Subsequently, the movable die 12 is separated from the first fixed die 11, turned 180°, moved in parallel, and clamped in contact with a second fixed die 14 having a frame-shaped cavity 14*a*, a recess 14*b* (communicating with the cavity 14*a*), a gate 14*c*, and the like, as shown in FIGS. 17 and 18. In this state, a second resin material 15 having a relatively high shrinkage factor (e.g., polyacetal resin having a shrinkage factor of $^{20}/_{1000}$) is injected into the cavity 14*a* through the gate 14*c* and is solidified by cooling, thereby molding the inner lever member 3.

In this case, since the shaft insertion holes 4*d* of the outer lever member 4 communicate with the cavity 14*a* of the fixed die 14, the second resin material 15 is filled even in the shaft insertion holes 4*d* and solidified so as to form the connecting shafts 3*d*. That is, since the second resin material 15 has a higher shrinkage factor than that of the first resin material 13, when the connecting shafts 3*d* are molded by cooling and solidifying the second resin material 15 inside the shaft insertion holes 4*d*, clearances are formed between the connecting shafts 3*d* and the shaft insertion holes 4*d*. This allows the connecting shafts 3*d* to be rotatable inside the shaft insertion holes 4*d*.

The plate 5 is formed by stamping a metal plate. As shown in FIGS. 10 and 11, the plate 5 has a pair of first louver portions 5*a* for slidably engaging the slide pins 3*c* therewith, a pair of second louver portions 5*b* for rotatably engaging the rotating shafts 4*c* therewith, three third louver portions 5*c* projecting to be inserted in retaining holes 6*a* of the holding plate 6, which will be described later, and a through hole 5*d* for inserting therein the rubber click member 8, which will be described later. The through hole 5*d* may be replaced with a cutout.

As shown in FIG. 11, the first louver portions 5*a* and the second louver portions 5*b* are nearly L-shaped in profile and are oriented in opposite directions. The through hole 5*d* can be formed simultaneously with stamping of the plate 5 from a metal plate, and the first to third louver portions 5*a* to 5*c* can be simultaneously formed by bending.

The cross-linked member 10 is placed on the plate 5 so that the lower end of the inner lever member 3 is slidably engaged and the lower end of the outer lever member 4 is rotatably engaged. Therefore, the cross-linked member 10 is tiltably mounted on the plate 5, the upper end of the inner lever member 3 is rotatably engaged with the actuator 2, and the upper end of the outer lever member 4 is slidably engaged with the actuator 2. As shown in FIG. 12, the actuator 2, the cross-linked member 10, and the plate 5 form a single unit.

The holding plate 6 is also formed by stamping a metal plate. As shown in FIG. 13, the holding plate 6 has retaining holes 6*a* in which the third louver portions 5*c* of the plate 5 are inserted, a through hole 6*b* for accommodating the main body of the plate 5, and raised portions 6*c* (FIG. 14) raised like a trapezoid having a height corresponding to the thickness of the third louver portions 5*c*.

While FIG. 1 shows the plate 5 placed on the holding plate 6 for convenience of explaining the overall configuration, in fact, the plate 5 is placed into the holding plate 6 from below with the third louver portions 5*c* inserted in the retaining holes 6a of the holding plate 6, and the main body of the plate 5 is held inside the through hole 6*b* of the holding plate 6 so that the first to third louver portions 5*a* to 5*c* of the plate 5 protrude from the upper surface of the holding plate 6, as shown in FIG. 13.

Referring to FIG. 1, the membrane switch 7 is sandwiched between the holding plate 6 and the support plate 9. The membrane switch 7 has a structure in which spacers are interposed between an upper sheet having multiple upper electrodes on its lower surface and a lower sheet having multiple lower electrodes on its upper surface. The upper electrodes and the lower electrodes are opposed to each other with a predetermined clearance therebetween so as to form switch portions. The switch portions are disposed below the through hole 5*d* of the plate 5.

As shown in FIG. 1, the rubber click member 8 shaped like an inverted bowl is placed on the switch portions of the membrane switch 7 so that its upper end face is in contact with the pressing portion 2*e* of the actuator 2. A pressing protuberance 8*a* projects downward from the inner side of the rubber click member 8 so as to face the upper electrodes of the membrane switch 7 disposed therebelow.

The operation of the key switch will now be described. When an operator presses the key top 1 in a switch-off state shown in FIG. 1, the tilting legs 3*a* and 4*a* of the lever members 3 and 4 tilt in response to the downward movement of the actuator 2 so as to fold the cross-linked member 10 down. When the key top 1 is moved by a predetermined amount, the rubber click member 8 pressed by the pressing portion 2*e* of the actuator 2 is buckled, the pressing protuberance 8*a* presses and bends the upper sheet of the membrane switch 7, and the upper electrodes of the switch portions contact the lower electrodes, thereby turning the switch on.

When the key top 1 is in the lowermost position, the first and second louver portions 5*a* and 5*b* are held inside a peripheral wall 1*d* of the key top 1. This permits a lower profile of the key switch.

When the pressing force applied to the key top 1 is removed in this switch-on state, the buckled rubber click member 8 returns to its initial shape because of elasticity. Therefore, the upper electrodes of the membrane switch 7 separate from the lower electrodes to return to a switch-off state, and the actuator 2 is pushed up. Consequently, the cross-linked member 10 is expanded up, and the key top 1 is pushed up to the initial position shown in FIG. 1.

Figure 19:
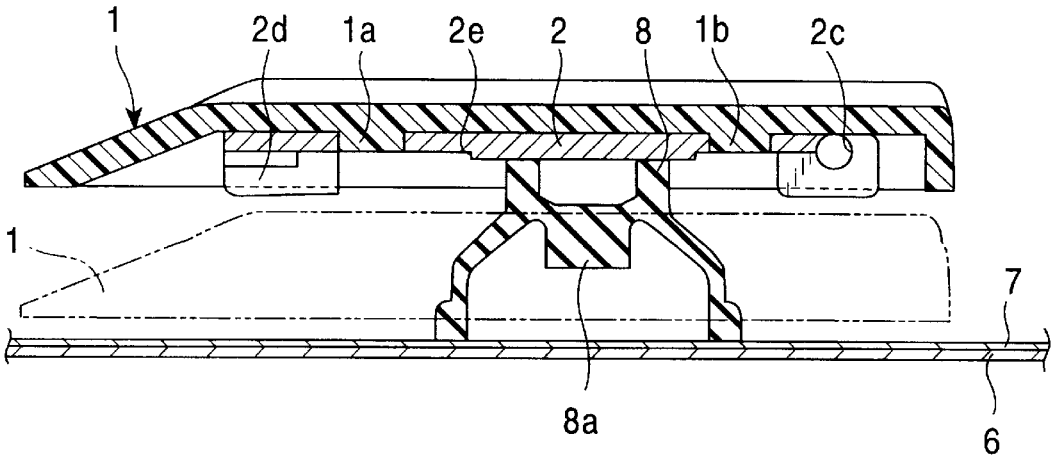
FIG. 19 is a cross-sectional view of a key switch in a switch-off state according to a second embodiment of the present invention.
Figure 21:
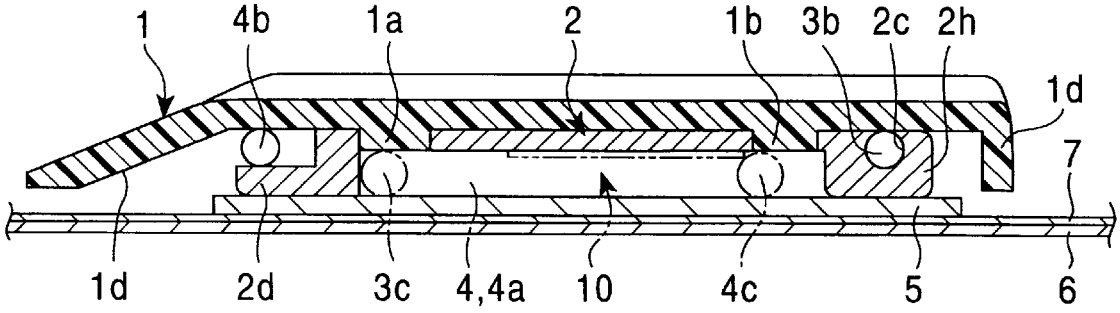
FIG. 21 is a cross-sectional view of the key switch in a switch-on state.
Figure 22:
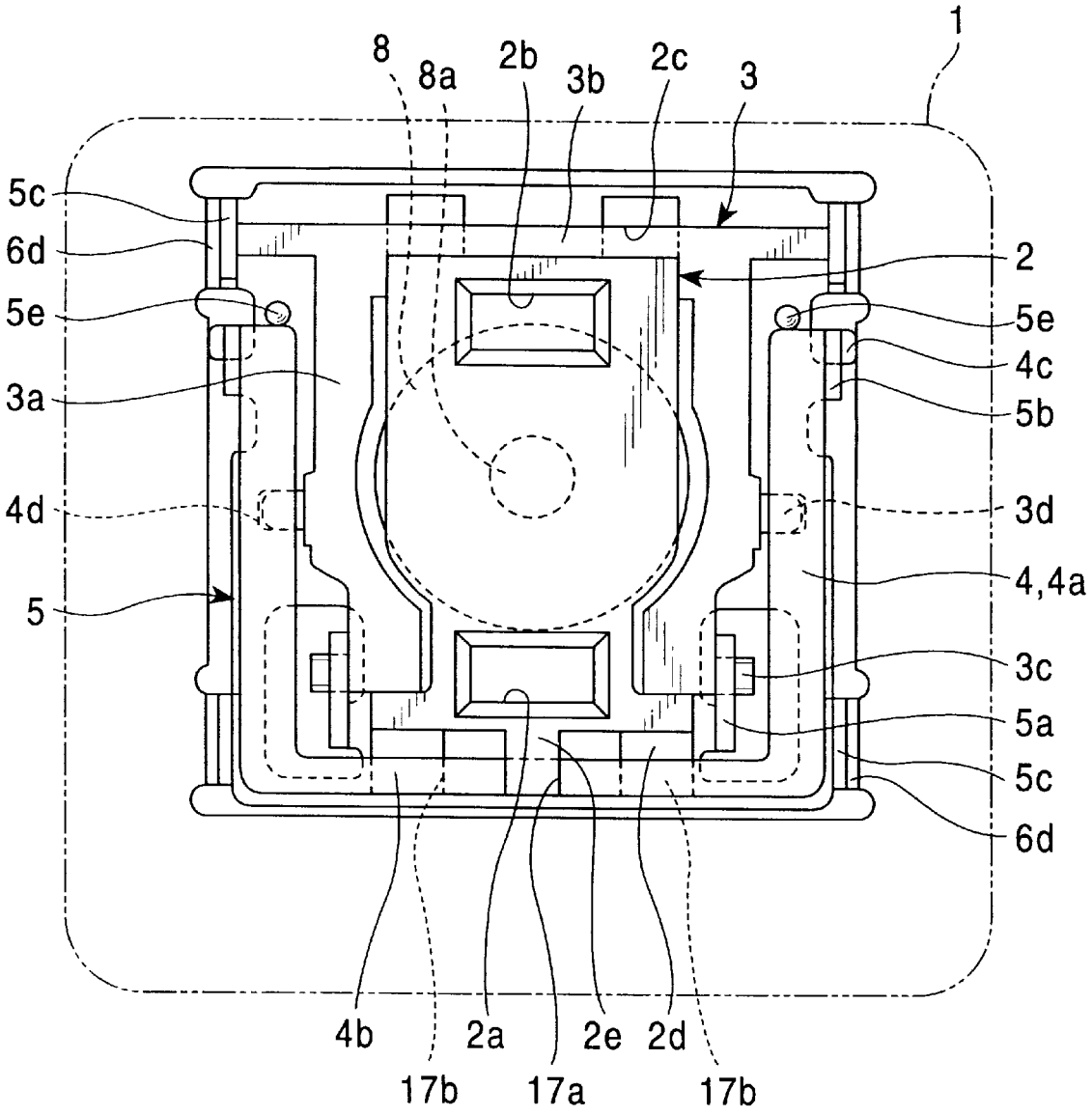
FIG. 22 is a plan view of the key switch.
Figure 23:
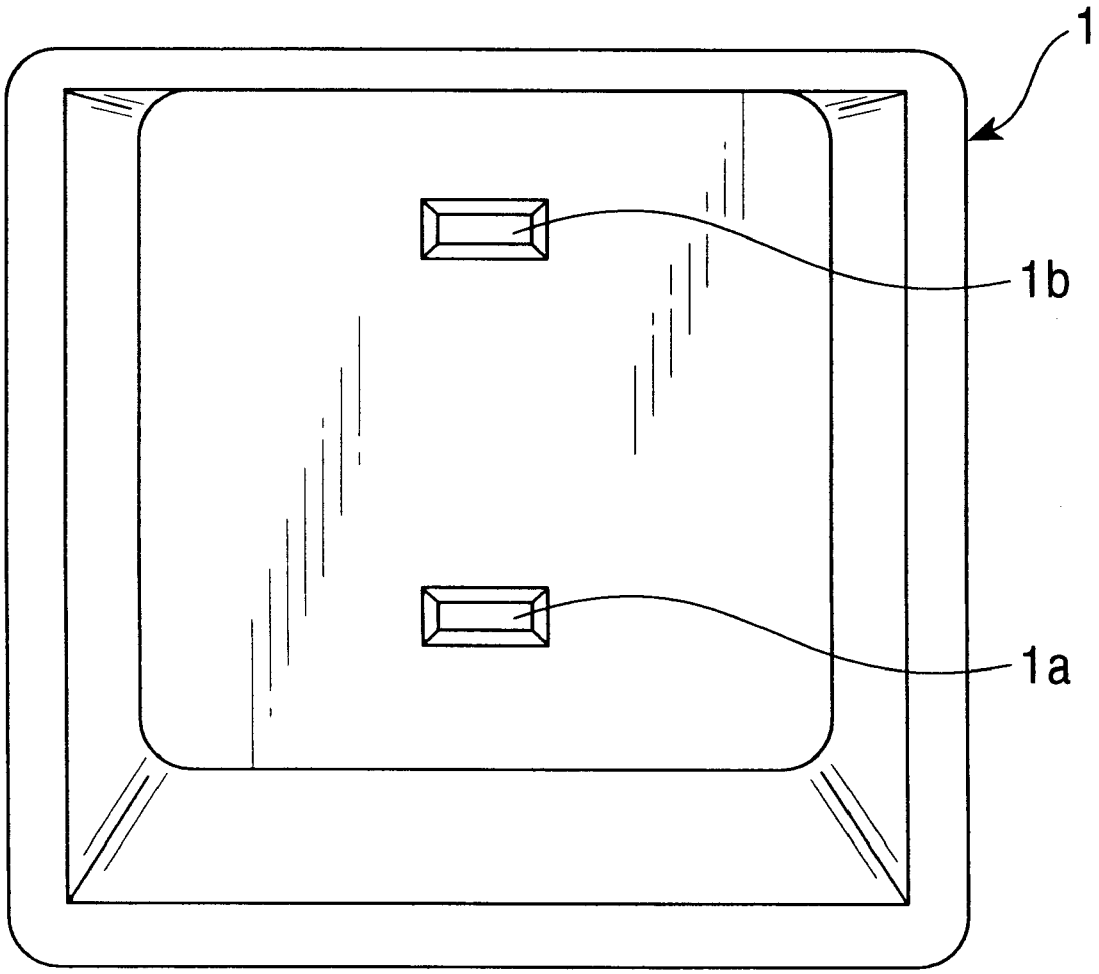
FIG. 23 is a rear view of a key top.
Figure 25:
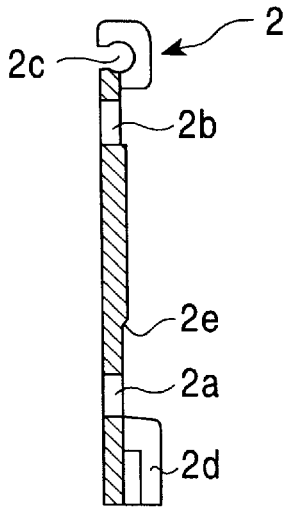
FIG. 25 is a cross-sectional view of the actuator, taken along line 25—25 in FIG. 24.
Figure 26:
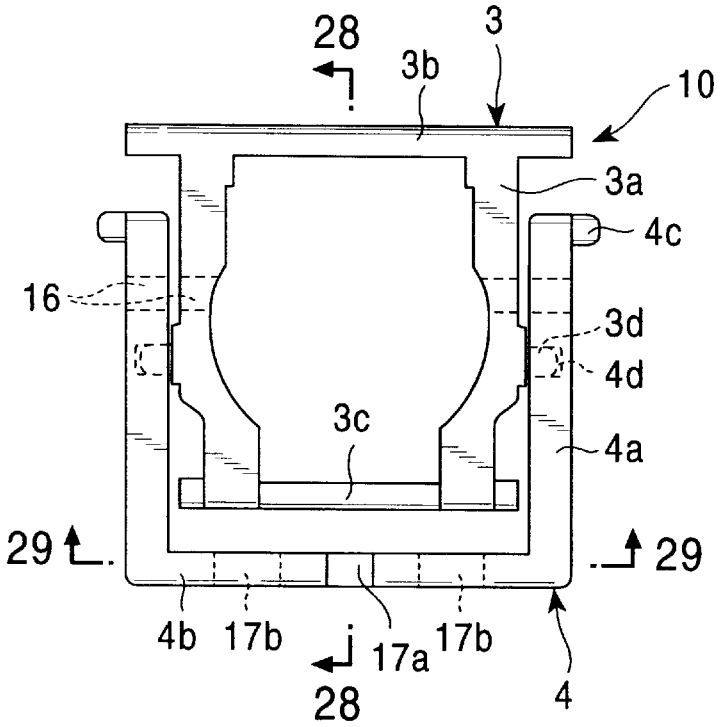
FIG. 26 is a plan view of a cross-linked member.
Figure 27:
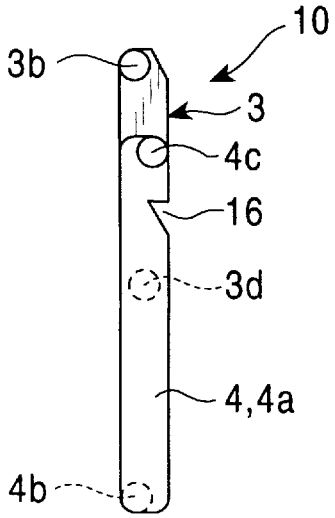
FIG. 27 is a side view of the cross-linked member.
Figure 28:
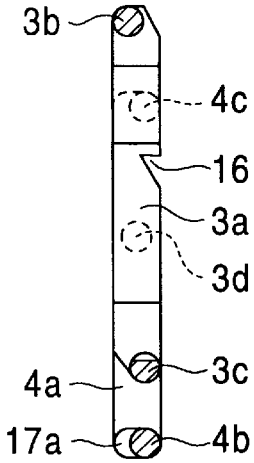
FIG. 28 is a cross-sectional view of the cross-linked member, taken along line 28—28 in FIG. 26.
Figure 29:
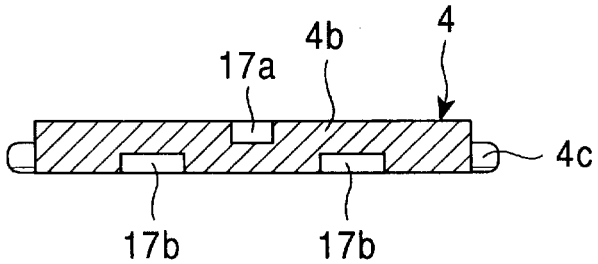
FIG. 29 is a cross-sectional view of the cross-linked member, taken along line 29—29 in FIG. 26.
Figure 30:
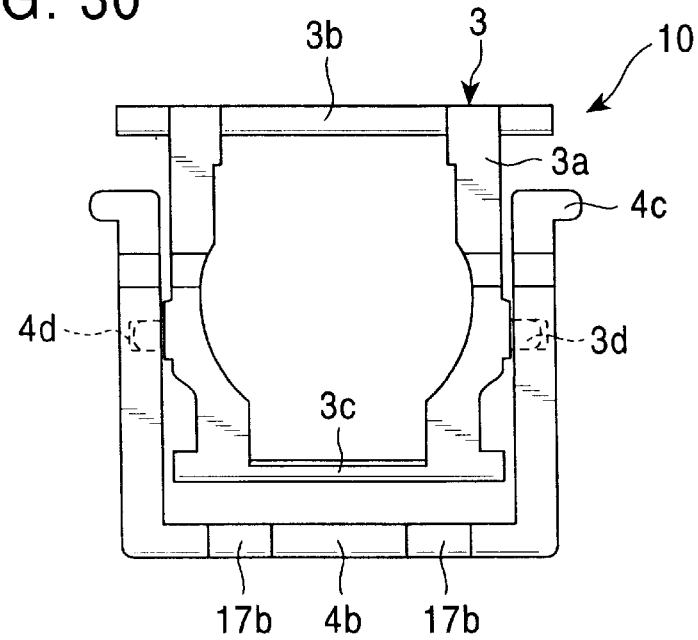
FIG. 30 is a rear view of the cross-linked member.
Figure 33:
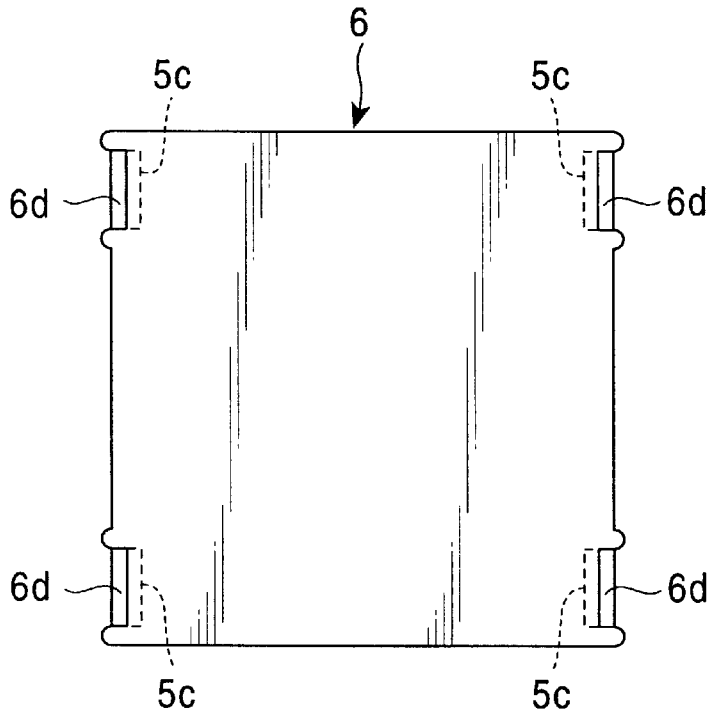
FIG. 33 is a plan view showing the principal part of a holding plate.
Figure 34:
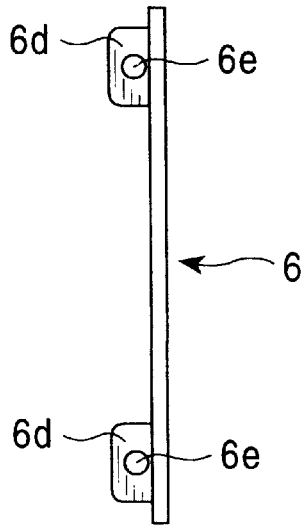
FIG. 34 is a side view showing the principal part of the holding plate.
Figure 35:
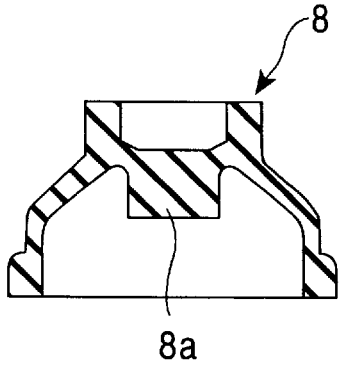
FIG. 35 is a cross-sectional view of a rubber click member.
Figure 36:
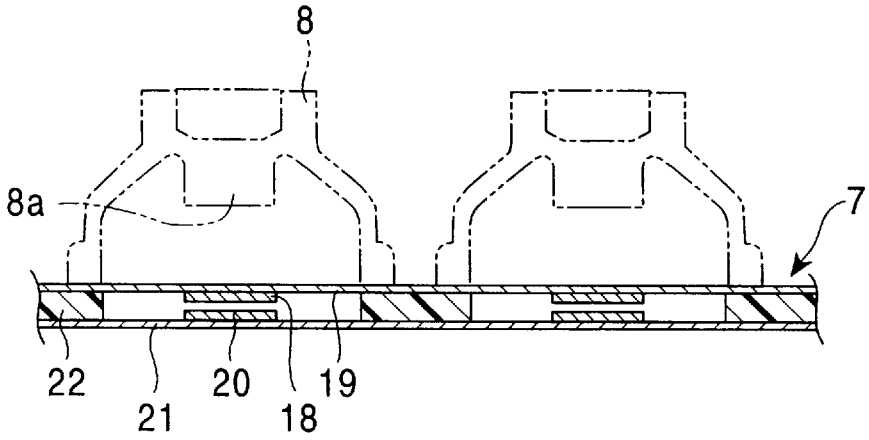
FIG. 36 is an enlarged sectional view showing the principal part of a membrane switch.
Figure 37:
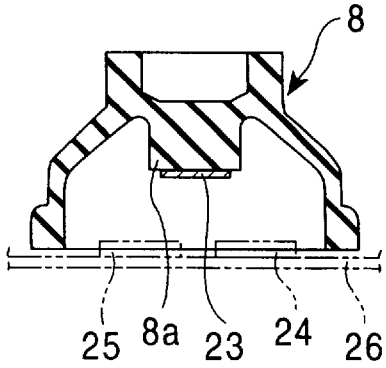
FIG. 37 is a cross-sectional view showing other examples of the rubber click member and the membrane switch.

A second embodiment of the present invention will be described below with reference to FIGS. 19 to 37. FIG. 19 is a cross-sectional view of a key switch in a switch-off state, from which a cross-linked member is omitted, FIG. 20 is a cross-sectional view of the key switch in the switch-off state, from which a rubber click member is omitted, FIG. 21 is a cross-sectional view of the key switch in a switch-on state, from which the rubber click member is omitted, FIG. 22 is a plan view of the key switch, FIG. 23 is a rear view of the key top, FIG. 24 is a plan view of an actuator, FIG. 25 is a cross-sectional view of the actuator, taken along line 25—25 in FIG. 24, FIG. 26 is a plan view of the cross-linked member, FIG. 27 is a side view of the cross-linked member, FIG. 28 is a cross-sectional view of the cross-linked member, taken along line 28—28 in FIG. 26, FIG. 29 is a cross-sectional view of the cross-linked member, taken along line 29—29 in FIG. 26, FIG. 30 is a rear view of the cross-linked member, FIG. 31 is a plan view of a plate, FIG. 32 is a side view of the plate, FIG. 33 is a plan view showing the principal part of a holding plate, FIG. 34 is a side view showing the principal part of the holding plate, FIG. 35 is a cross-sectional view of a rubber click member, FIG. 36 is an enlarged sectional view showing the principal part, of a membrane switch, and FIG. 37 is a cross-sectional view showing other examples of the rubber click member and the membrane switch.

Since the key switch of this embodiment is substantially similar in configuration and function to the key switch of the first embodiment, description will be given only to differences therebetween.

Figure 24:
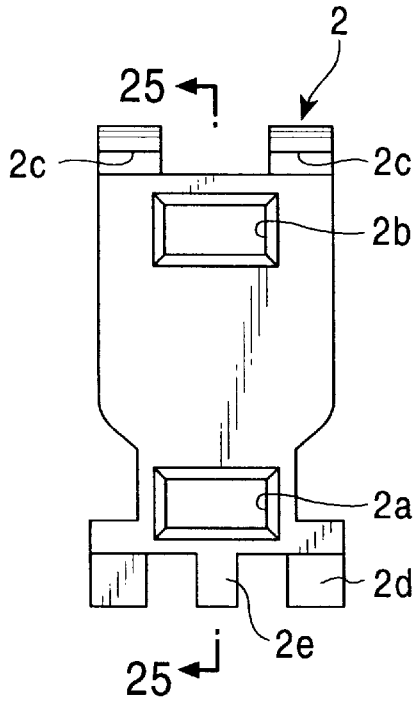
FIG. 24 is a plan view of an actuator.

As shown in FIG. 24, a shaft groove 2*c* of an actuator 2 is divided into a plurality of relatively short portions. As shown in FIGS. 26 to 28, triangular notches 16 are formed on the lower surfaces of an inner lever member 3 and an outer lever member 4 for alignment by a parts feeder. As shown in FIG. 29, a slide shaft 4*b* of the outer lever member 4 is provided with a holding recess 17*a* on its upper side and two holding recesses 17*b* on its lower side. As shown in FIG. 22, an upper jut 2*e* of the actuator 2 is held in the holding recess 17*a*, and lower juts 2*d* are held in the holding recesses 17*b*.

Figure 20:
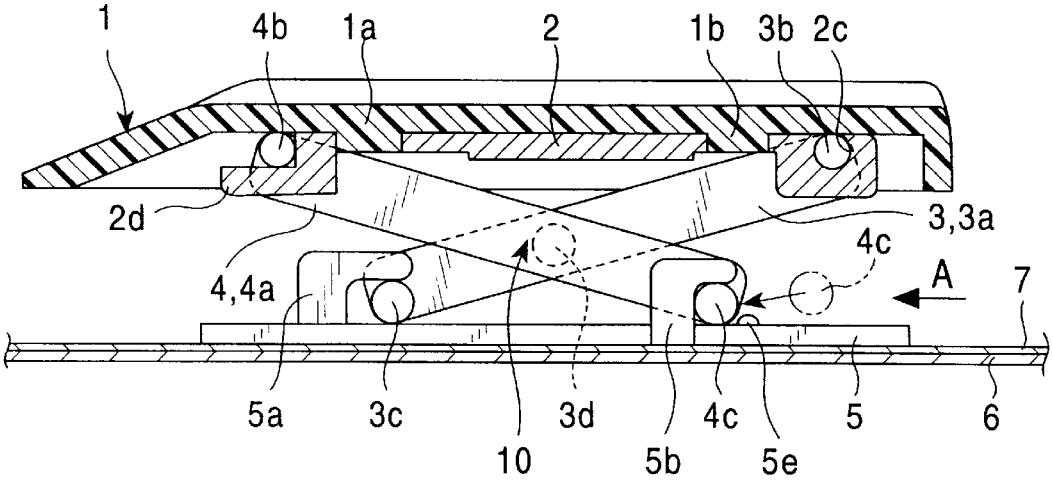
FIG. 20 is a cross-sectional view of the key switch in the switch-off state.
Figure 31:
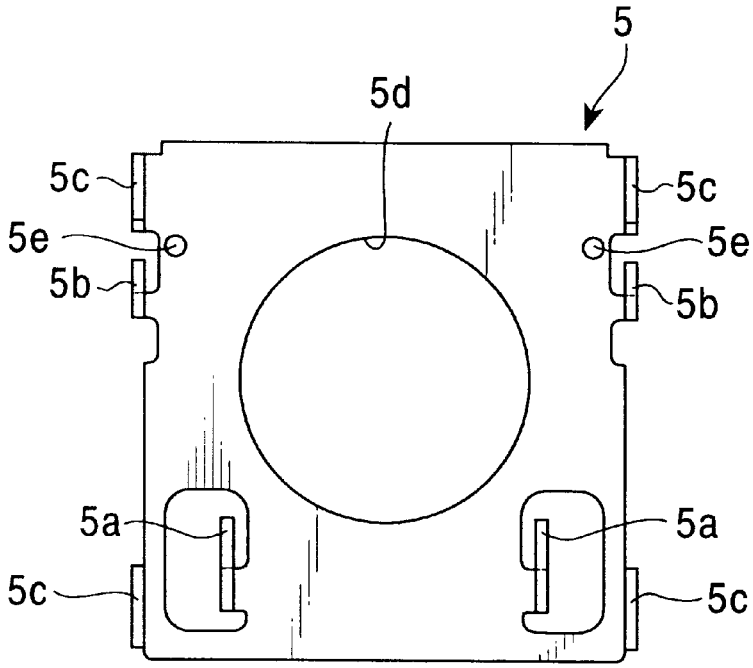
FIG. 31 is a plan view of a plate.
Figure 32:
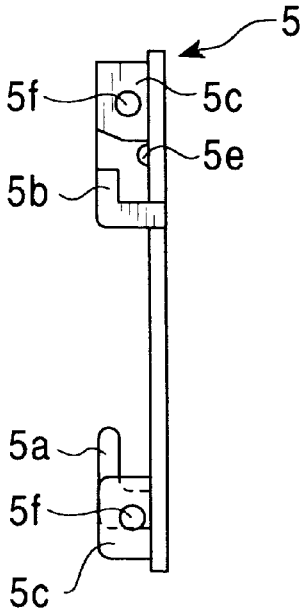
FIG. 32 is a side view of the plate.

As shown in FIGS. 20, 31, and 32, angular protuberances 5*e* are formed obliquely below the leading ends of second louver portions 5*b* of a plate 5. The distance between the protuberances 5*e* and the leading ends of the second louver portions 5*b* is set to be slightly smaller than the diameter of rotating shafts 4*c* of the outer lever member 4. The rotating shafts 4*c* are forcibly press-fitted, that is, snap-fitted between the second louver portions 5*b* and the protuberances 5*e* (see FIG. 20). Subsequently, the protuberances 5*e* function as stoppers for preventing the rotating shafts 4*c* from being displaced when a key top 1 is depressed. Protuberances 5*e* are also provided in the plate 5 of the first embodiment (see FIGS. 1, 2, 10, and 11). A through hole 5*d* and the protuberances 5*e* of the plate 5 are formed simultaneously with stamping of the plate 5 from a metal plate, and first to third louver portions 5*a* to 5*c* are simultaneously formed by bending.

The first louver portions 5*a* and the second louver portions 5*b* are opened on the same side, as shown in FIG. 20. A cross-linked member 10 can be mounted on the plate 5 by being moved in the direction of arrow A in FIG. 20 so that a slide pin 3*c* is inserted in the first louver portions 5*a* and the rotating shafts 4*c* are snapped in the second louver portions 5*b*. This facilitates assembly operation.

While the plate 5 is stamped out from a metal plate in this embodiment, it may be formed of an integrally molded synthetic resin plate with louver portions and a through hole.

The third louver portions 5*c* stand adjacent to the four corners of the plate 5, and louver portions 6*d* stand corresponding thereto adjacent to the four corners of a holding plate 6, as shown in FIGS. 33 and 34. When the plate 5 is placed on the holding plate 6 via a membrane switch 7, the third louver portions 5*c* of the plate 5 are fitted in the louver portions 6*d* of the holding plate 6, as shown in FIGS. 22 and 33. Furthermore, protuberances 6*e* (see FIG. 34) formed in the louver portions 6*d* are snapped in through holes 5*f* (see FIG. 32) formed in the third louver portions 5*c*, whereby the plate 5 is held and positioned by the holding plate 6.

While the plate 5 is accommodated in the through hole 6*b* of the holding plate 6 in the first embodiment, as shown in FIG. 13, the membrane switch 7 and the plate 5 are placed on the nearly flat holding plate 6 having no through hole in this embodiment, as shown in FIG. 33.

The membrane switch 7 has a structure in which spacers 22 are interposed between a flexible upper sheet 19 having multiple upper electrodes 18 on its lower surface and a lower sheet 21 having multiple lower electrodes 20 on its upper surface. The upper electrodes 18 and the lower electrodes 20 are opposed to each other with a predetermined clearance therebetween so as to form switch portions. Each switch portion is disposed below a pressing protuberance 8*a* of a rubber click member 8.

When the key top 1 is in the lowermost position, shaft portions 2*h* of the shaft grooves 2*c* of the actuator. 2 and the bottom faces of the lower juts 2*d* are in contact with the plate 5, and the shaft portions 2*h*, the juts 2*d*, and the first to third louver portions 5*a*, 5*b*, and 5*c* are held inside a peripheral wall id of the key top 1.

FIG. 37 shows other examples of the rubber click member 8 and the membrane switch 7. A conductive portion 23 is formed on the lower surface of a pressing projection 8*a* of a rubber click member 8, and a sheet 26 having a first electrode 24 and a second electrode 25 separately formed is placed below the conductive portion 23. When the rubber click member 8 is pressed, the conductive portion 23 contacts both the first and second electrodes 24 and 25, thereby turning the switch on.

Figure 38:
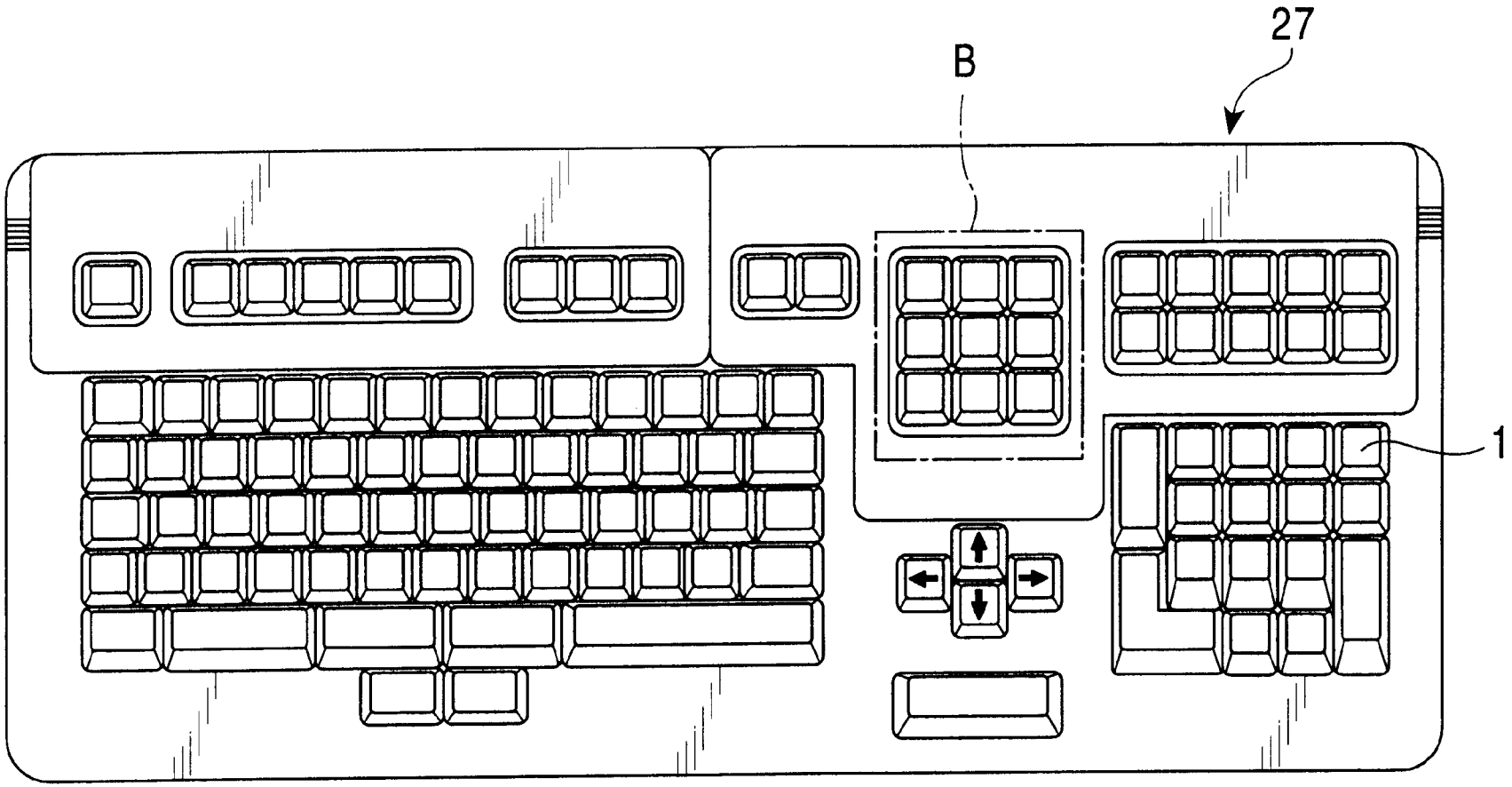
FIG. 38 is a plan view of a keyboard input device.
Figure 39:
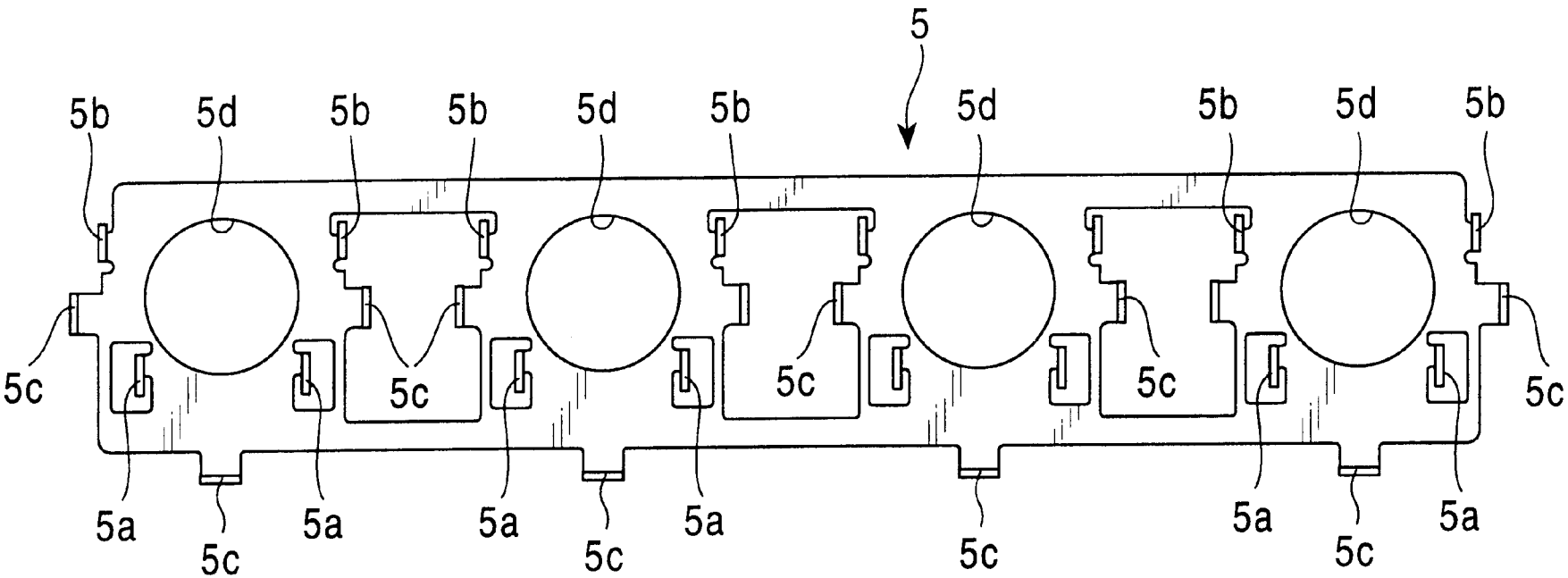
FIG. 39 is a plan view of a plate according to a third embodiment of the present invention.

A third embodiment of the present invention will now be described with reference to FIGS. 38 to 40. FIG. 38 is a plan view of a keyboard input device, FIG. 39 is a plan view of a plate, and FIG. 40 is a plan view of a membrane switch.

Referring to FIG. 38, a plurality of key tops 1 are arranged lengthwise and breadthwise in a keyboard input device 27. Corresponding to the layout of the key tops 1, a plate 5 which is long sideways is used, as shown in FIG. 39. In the plate 5, first to third louver portions 5*a* to 5*c* and through holes 5*d* are formed breadthwise in a plurality of sets (four sets in this embodiment). While four plates having the same shape as that of the plate 5 of the first embodiment are used in this embodiment, a plurality of plates having the same shape as that of the plate 5 of the second embodiment may be used.

Figure 40:
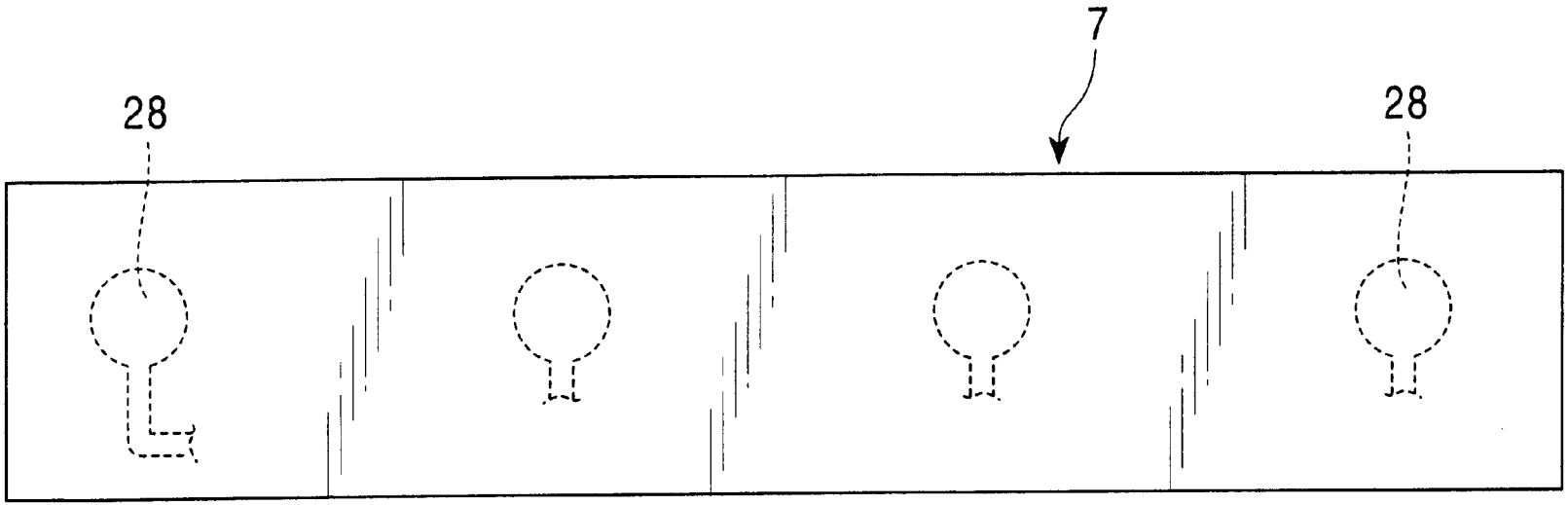
FIG. 40 is a plan view of a membrane switch.

As shown in FIG. 40, a membrane switch 7 is also long: sideways and has switch portions 28 composed of electrodes at positions opposing the through holes 5*d* of the plate 5. The membrane switch 7 is placed under the plate 5.

The plate 5 having such a shape allows a plurality of (four in this embodiment) cross-linked members 10 to be arranged in parallel as a unit on the single plate 5. This makes it possible to efficiently perform assembly operation.

Figure 41:
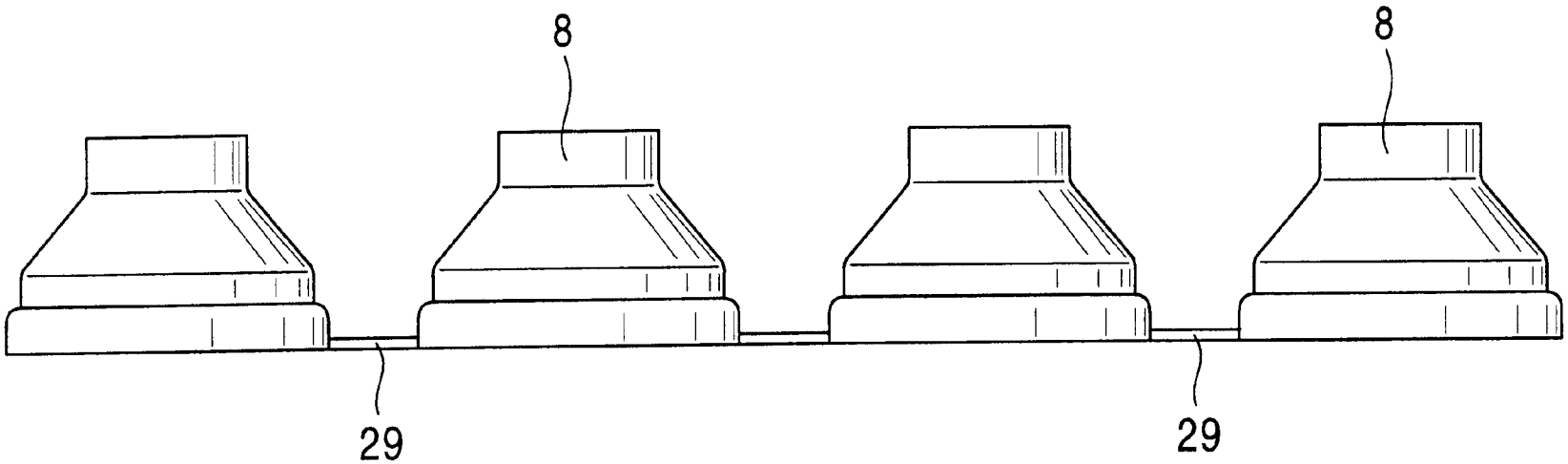
FIG. 41 is a side view of a rubber click member.

FIG. 41 shows another example of the rubber click member 8. In this example, a plurality of rubber click members 8 are connected at thin connecting portions 29 so as to form a single component and are placed on the plate 5 which is long sideways.

While a plurality of plates 5, membrane switches 7, and rubber click members 8 are arranged in a connected row in this embodiment, for example, they may be arranged lengthwise and breadthwise so as to form a block, as shown by a dotted-chain line B in FIG. 38.

Figure 42:
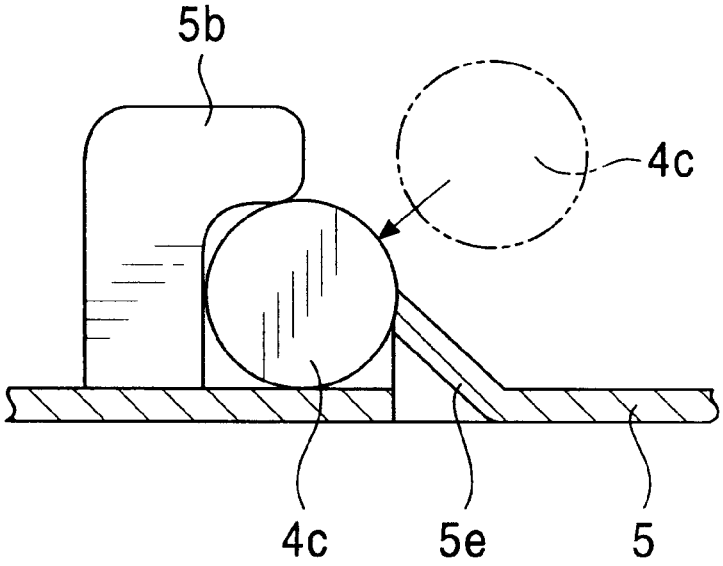
FIG. 42 is a partly enlarged sectional view of a plate according to a fourth embodiment of the present invention.
Figure 43:
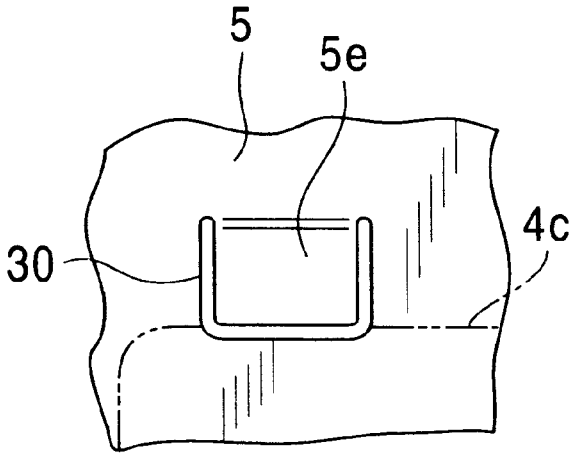
FIG. 43 is a partly enlarged plan view of the plate.

FIGS. 42 and 43 are a partly enlarged sectional view and a partly enlarged plan view, respectively, of a plate 5 according to a fourth embodiment of the present invention. In this embodiment, a protuberance 5*e*, which is slightly elastic, is formed by making an angular-U-shaped cut 30 and raising a portion surrounded by the cut 30, as shown in FIG. 43. The distance between the leading end of a second louver portion 5*b* and the protuberance 5*e* is set to be slightly shorter than the outer diameter of a rotating shaft 4*c*. The rotating shaft 4*c* is snap-fitted by using elasticity of the protuberance 5*e*. After that, the protuberance on 5*e* functions as a stopper for preventing the rotating shaft 4*c* from being displaced.

As described above, in the above embodiments, the fitting projections 1*a* and 1*b* of the key top 1 are press-fitted in the actuator 2 for supportingly engaging with the upper ends of a pair of lever members 3 and 4 in the assembly process. Therefore, after the cross-linked member 10 as a unit is mounted on the holding plate 6 on the membrane switch 7, the key top 1 can be substantially easily attached thereto. Moreover, since the actuator 2 serves to supportingly engage with the upper end of the cross-linked member 10 and to depress the upper end face of the rubber click member 8, the bottom shape of the key top 1 is simplified, and a complicated and expensive die is not required to mold the key top 1.

Since the outer lever member 4 and the inner lever member 3 are sequentially molded into the cross-linked member 10 with the connecting shafts 3*d* rotatably fitted in the shaft insertion holes 4*d*, there is no need to perform a troublesome assembly operation of manually connecting the lever members 3 and 4. This substantially increases assembly efficiency.

The lever members 3 and 4 are mounted on the plate 5 having the louver portions 5*a* and 5*b* so as to form the cross-linked member 10 as a unit. Therefore, it is possible to check whether or not the cross-linked member 10 operates properly before the cross-linked member 10 is mounted on the membrane switch 7.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A key switch comprising:

a pair of lever members with intersections thereof rotatably connected;

an actuator for rotatably engaging the upper end of one of said lever members therewith and slidably engaging the upper end of the other lever member therewith, wherein said actuator is supported movably up and down by said lower members and said upper ends of said lower members are engaged only to said actuator;

a key top retained on said actuator;

an elastic member for urging said key top upward via said actuator; and a switch device for performing switching in response to the upward and downward movement of said key top.

2. A key switch according to claim 1, wherein said elastic member is an elastic material having a click function.

3. A key switch according to claim 1, wherein said actuator has a retaining hole or a projection, the bottom of said key top has a projection or a retaining hole, and said projection is fitted in said retaining hole.

4. A key switch according to claim 1, wherein said switch device is sheet-shaped.

5. A key switch comprising:

a switch device having a plurality of switch bodies consecutively arranged at predetermined intervals;

a support member placed on said switch device so as to have through portions and support portions at positions corresponding to said switch bodies of said switch device; and switch pressing portions supported by said support portions of said support member and placed above said through portions so as to individually press said switch bodies, wherein each of said switch pressing portions comprises:

a pair of lever members with intersections thereof rotatably connected;

an actuator for rotatably engaging the upper end of one of said lever members therewith and slidably engaging the upper end of the other lever member therewith;

a key top retained on said actuator and supported by said lever members so as to move up and down; and an elastic member for urging said key top upward via said actuator.

6. A key switch according to claim 5, wherein said elastic member is made of an elastic material having a click function, and a plurality of said elastic materials are consecutively connected corresponding to said switch bodies.

7. A key switch according to claim 5, wherein said actuator has a retaining hole or a projection, the bottom of said key top has a projection or a retaining hole, and said projection is fitted in said retaining hole.

8. A key switch according to claim 5, wherein said switch device is sheet-shaped.

9. A key switch comprising:

a pair of lever members with intersections thereof rotatably connected;

a key top supported by said lever members so as to move up and down;

an elastic member for urging said key top upward;

a switch device for performing switching in response to the upward and downward movement of said key top; and a plate formed by bending a metal plate and having a first louver portion for slidably engaging the lower end of one of said lever members therewith and a second louver portion for rotatably engaging the lower end of the other lever member therewith, wherein said plate has a through portion, a pressing protuberance formed in said elastic member is placed above said through portion, said switch device is placed below said through portion, and said pressing protuberance and said switch device are opposed to each other via said through portion.

10. A key switch according to claim 9, further comprising:

an actuator for rotatably engaging the upper end of said one of said lever members therewith and slidably engaging the upper end of said other lever member therewith, said actuator retaining said key top.

11. A key switch according to claim 10, wherein said actuator has a retaining hole or a projection, the bottom of said key top has a projection or a retaining hole, and said projection is fitted in said retaining hole.

12. A key switch according to claim 9, further comprising:

a base member for positioning and holding said plate, wherein said switch device is held between said base member and said plate.

13. A key switch comprising:

a pair of lever members with intersections thereof rotatably connected;

a key top supported by said lever members so as to move up and down;

a plate for supportingly mounting said lever members thereon;

a holding plate for holding and retaining said plate;

an elastic member for urging said key top upward;

a sheetlike switch device for performing switching in response to the upward and downward movement of said key top; and a support plate for mounting said sheetlike switch device thereon, wherein said plate and said holding plate each have a through hole for inserting said elastic member therein, and said sheetlike switch device is held between said holding plate and said support plate.

14. A key switch according to claim 13, wherein said plate has a first louver portion for rotatably engaging the lower end of one of said lever members therewith and a second louver portion for slidably engaging the lower end of the other lever member therewith.

15. A key switch according to claim 13, wherein a plurality of pairs of said lever members are supportingly mounted on said plate.

16. A key switch comprising:

a pair of lever members with intersections thereof rotatably connected;

a key top supported by said lever members so as to move up and down;

an elastic member for urging said key top upward;

a switch device for performing switching in response to the upward and downward movement of said key top; and a plate having a first louver portion for slidably engaging the lower end of one of said lever members therewith, a second louver portion for rotatably engaging the lower end of the other lever member therewith, and a protuberance formed adjacent to the leading end of said second louver portion, wherein the lower end of said other lever member is rotatably snapped in said second louver portion from between the leading end of said second louver portion and said protuberance.

17. A key switch according to claim 16, further comprising:

an actuator for rotatably engaging the upper end of said one lever member therewith and slidably engaging the upper end of said other lever member therewith, said actuator retaining said key top.

18. A key switch according to claim 17, wherein said actuator has a retaining hole or projection, the bottom of said key top has a projection or a retaining hole, and said projection is fitted in said retaining hole.

19. A key switch according to claim 16, wherein said plate has a through portion, a pressing protuberance formed in said elastic member is placed above said through portion, said switch device is placed below said through portion, and said pressing protuberance and said switch device are opposed to each other via said through portion.

20. A key switch according to claim 19, further comprising:

a base member for positioning and holding said plate, wherein said switch device is held between said base member and said plate.

21. A key switch comprising:

a pair of lever members with intersections thereof rotatably connected;

an actuator having a shaft groove rotatably engaging the upper end of one of said lever members therewith and a sliding groove slidably engaging the upper end of the other lever member therewith;

a key top retained on said actuator and supported movably up and down by said lever members;

an elastic member for urging said key top upward via said actuator; and a switch device for performing switching in response to the upward and downward movement of said key top.

22. The key switch recited in claim 21 wherein the sliding groove is formed by at least one jut extending from a top side of the actuator and at least one jut extending from a bottom side of the actuator.

23. A method of forming a key switch, the method comprising:

assembling a pair of lever members by rotatably connecting the lever members at an intersection;

forming a cross-linked subassembly by connecting the lower ends of the assembled pair to a plate;

engaging the upper ends of the lever members of the cross-linked assembly to an actuator; and attaching a key top to the actuator after engagement of the actuator with the upper ends of the lever members.

24. The method of forming a key switch recited in claim 23, wherein the keytop is attached to the actuator using projections from the keytop pressfit into the actuator.

25. The method of forming a key switch recited in claim 23, wherein engagement of the actuator to the upper ends of the cross-linked assembly is performed using a slide groove and a shaft groove formed on the actuator.

26. The method of forming a key switch recited in claim 23, wherein the plate is attached to a membrane switch, said membrane switch arranged to perform switching in response to vertical movement of the key top.

* * * * *